US005871876A

United States Patent [19]

Ikuno et al.

[11] Patent Number: 5,871,876

[45] Date of Patent: Feb. 16, 1999

[54] ELECTROPHOTOGRAPHIC PHOTOCONDUCTOR

[75] Inventors: Hiroshi Ikuno; Hiroshi Nagame, both of Numazu; Tetsuro Suzuki, Fuji; Hidetoshi Kami, Numazu; Jun Aoto, Odawara; Hiroshi Tamura, Susono; Narihito Kojima, Numazu; Tatsuya Niimi, Numazu, all of Japan

[73] Assignee: Ricoh Company, Ltd., Tokyo, Japan

[21] Appl. No.: 862,259

[22] Filed: May 23, 1997

[30] Foreign Application Priority Data

May 24, 1996 [JP] Japan ..... 8-151813

[51] Int. Cl.[6] ..... G03G 5/047

[52] U.S. Cl. ..... 430/59; 430/96

[58] Field of Search ..... 430/58, 59, 96

[56] References Cited

U.S. PATENT DOCUMENTS

| | | | |
|---|---|---|---|
| 5,350,653 | 9/1994 | Masayuki et al. | 430/58 |
| 5,427,880 | 6/1995 | Hiroshi et al. | 430/54 |
| 5,486,438 | 1/1996 | Masayuki | 430/58 |
| 5,492,784 | 2/1996 | Masao et al. | 430/58 |
| 5,639,581 | 6/1997 | Iwasaki et al. . | |
| 5,686,215 | 11/1997 | Bergtjord et al. | 430/63 |

*Primary Examiner*—John Goodrow

*Attorney, Agent, or Firm*—Oblon, Spivak, McClelland, Maier & Neustadt, P.C.

[57] ABSTRACT

An electrophotographic photoconductor has an electroconductive support and a photoconductive layer formed thereon, which contains a charge transport material with a polycarbonate structure having a triarylamino group at least on the main chain or side chain thereof, and a charge generation material with a phthalocyanine skeleton.

11 Claims, 1 Drawing Sheet

ELECTROPHOTOGRAPHIC PHOTOCONDUCTOR

BACKGROUND OF THE INVENTION

Field of the Invention

The present invention relates to an electrophotographic photoconductor used in a copying machine, a laser printer and a laser facsimile apparatus.

Discussion of Background

The Carlson process and other processes obtained by modifying the Carlson process are conventionally known as the electrophotographic methods, and widely utilized in the copying machine and printer. In a photoconductor for use with the electrophotographic method, an organic photoconductive material is now widely used because such a photoconductor can be manufactured at low cost by mass production, and causes no environmental pollution.

Many kinds of organic photoconductors are conventionally proposed, for example, a photoconductor employing a photoconductive resin such as polyvinylcarbazole (PVK); a photoconductor comprising a charge transport complex of polyvinylcarbazole (PVK) and 2,4,7-trinitrofluorenone (TNF); a photoconductor of a pigment dispersed type in which a phthalocyanine pigment is dispersed in a binder resin; and a function-separating photoconductor comprising a charge generation material and a charge transport material. In particular, the function-separating photoconductor has now attracted considerable attention.

When the function-separating photoconductor is charged to a predetermined polarity and exposed to light, the light pass through a transparent charge transport layer, and is absorbed by a charge generation material in a charge generation layer. The charge generation material generates charge carriers by the absorption of light. The charge carriers generated in the charge generation layer are injected into the charge transport layer, and move in the charge transport layer depending on the electrical field generated by the charging process. Thus, latent electrostatic images are formed on the surface of the photoconductor by neutralizing the charge thereon. As is known, it is effective that the function-separating electrophotographic photoconductor employ in combination a charge transport material having an absorption intensity mainly in the ultraviolet region, and a charge generation material having an absorption intensity mainly in the visible region.

Many low-molecular weight compounds have been developed to obtain the charge transport materials. However, it is necessary that the low-molecular weight charge transport material be dispersed and mixed with an inert polymer to prepare a coating liquid for a charge transport layer because the film-forming properties of such a low-molecular weight compound is very poor. The charge transport layer thus prepared by using the low-molecular weight charge transport material and the inert polymer is generally so soft that the charge transport layer easily tends to peel away during the repeated electrophotographic operations by the Carlson process.

In addition, the charge mobility has its limit in the above-mentioned charge transport layer employing the low-molecular weight charge transport material. Therefore, the Carlson process cannot be carried out at high speed, and the size of apparatus cannot be decreased due to the poor charge mobility in the charge transport layer when the amount of low-molecular weight charge transport material is 50 wt. % or less to the total weight of the charge transport layer. Although the charge mobility can be improved by increasing the amount of charge transport material, the film-forming properties of the charge transport layer deteriorate.

To solve the problems of the low-molecular weight charge transport material, considerable attention has been paid to a high-molecular weight charge transport material. For example, a variety of high-molecular weight charge transport materials are proposed as disclosed in Japanese Laid-Open Patent Applications Nos. 51-73888, 54-8527, 54-11737, 56-150749, 57-78402, 63-285552, 1-1728, 1-19049 and 3-50555.

However, the photosensitivity of the function-separating laminated photoconductor in which a charge transport layer comprises a high-molecular weight charge transport material is extraordinarily inferior to that of the photoconductor employing a low-molecular weight charge transport material in the charge transport layer. It is eagerly desired to improve the photosensitivity in the photoconductor employing the high-molecular weight charge transport material.

SUMMARY OF THE INVENTION

Accordingly, an object of the present invention is to provide an electrophotographic photoconductor with high photosensitivity, capable of stably producing images for an extended period of time by employing a high-molecular weight charge transport material which shows excellent wear resistance even in the repeated operations.

The above-mentioned object of the present invention can be achieved by an electrophotographic photoconductor comprising an electroconductive support and a photoconductive layer formed thereon which comprises a charge transport material with a polycarbonate structure comprising a triarylamino group at least on the main chain or side chain thereof, and a charge generation material with a phthalocyanine skeleton.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

The structure of an electrophotographic photoconductor according to the present invention will now be described in detail by referring to FIGS. 1 to 3.

Figure 1:
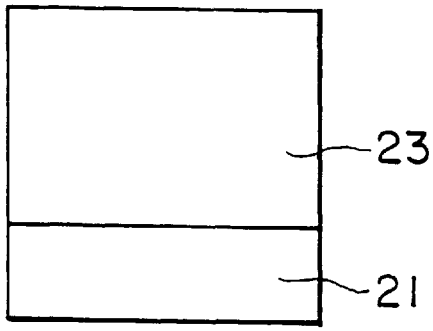
FIG. 1 is a schematic cross-sectional view which shows one embodiment of an electrophotographic photoconductor according to the present invention.

In FIG. 1, which shows one example of the cross-section of the electrophotographic photoconductor according to the present invention, a photoconductive layer 23 is provided on an electroconductive support 21.

Figure 2:
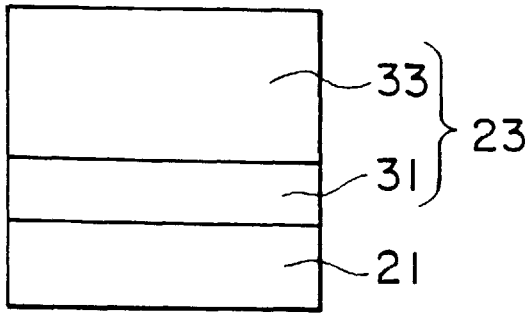
FIG. 2 is a schematic cross-sectional view which shows another embodiment of an electrophotographic photoconductor according to the present invention.

FIG. 2 shows another example of the cross-section of the electrophotographic photoconductor according to the present invention. As shown in FIG. 2, there is provided on an electroconductive support 21 a laminated photoconductive layer 23. In this case, the photoconductive layer 23 comprises a charge generation layer 31 and a charge transport layer 33 which are successively overlaid on the electroconductive support 21 in this order.

Figure 3:
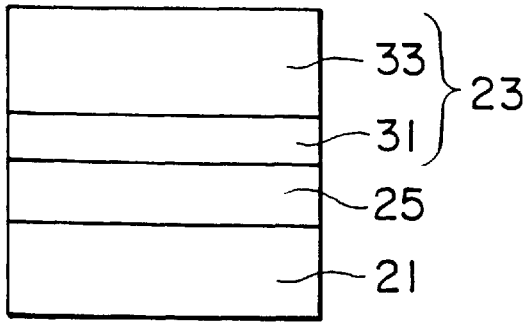
FIG. 3 is a schematic cross-sectional view which shows a further embodiment of an electrophotographic photoconductor according to the present invention.

FIG. 3 is a cross-sectional view of a further example of the electrophotographic photoconductor according to the present invention. In the photoconductor as shown in FIG. 3, an undercoat layer 25 is interposed between an electroconductive support 21 and a laminated photoconductive layer 23.

According to the present invention, the photoconductive layer 23 of the electrophotographic photoconductor comprises (i) a high-molecular weight charge transport material with a polycarbonate structure comprising a triarylamino group on the main chain and/or side chain thereof, and (ii) a charge generation material with a phthalocyanine skeleton.

In light of the advantages obtained from the present invention, it is particularly preferable to employ the following high-molecular weight charge transport materials of formulas (I) to (VIII).

The charge transport material of formula (I) for use in the present invention will now be explained in detail.

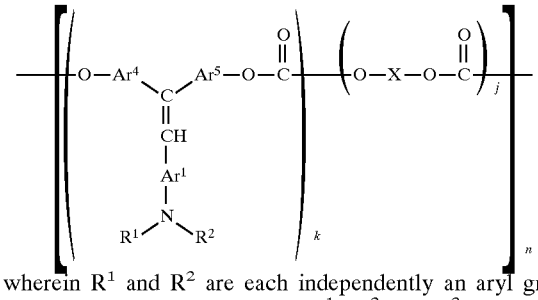

(I)

wherein $R^1$ and $R^2$ are each independently an aryl group which may have a substituent; $Ar^1$, $Ar^2$ and $Ar^3$, which may be the same or different, are each independently an arylene group; $0.1 \leqq k \leqq 1$; $0 \leqq j \leqq 0.9$; n is an integer of 5 to 5,000; X is a bivalent aliphatic group, bivalent cyclic aliphatic group or a bivalent group represented by formula (I-a):

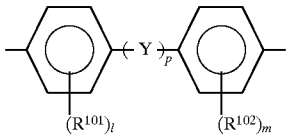

(I-a)

in which $R^{101}$ and $R^{102}$ are each independently an alkyl group which may have a substituent, an aryl group which may have a substituent or a halogen atom; L and m are each independently an integer of 0 to 4; p is an integer of 0 or 1, and when p=1, Y is a straight-chain, branched or cyclic alkylene group having 1 to 12 carbon atoms, —O—, —S—, —SO—, —$SO_2$—, —CO—, —CO—O—Z—O—CO— in which Z is a bivalent aliphatic group, or

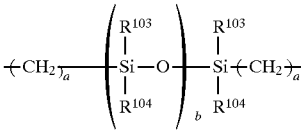

(I-b)

in which a is an integer of 1 to 20; b is an integer of 1 to 2,000; and $R^{103}$ and $R^{104}$ are each independently an alkyl group which may have a substituent or an aryl group which may have a substituent, and $R^{101}$, $R^{102}$, $R^{103}$ and $R^{104}$ may be the same or different.

Examples of the aryl group represented by $R^1$ and $R^2$ are as follows:

(1) Aromatic hydrocarbon groups such as phenyl group;

(2) Condensed polycyclic groups such as naphthyl group, pyrenyl group, 2-fluorenyl group, 9,9-dimethyl-2-fluorenyl group, azurenyl group, anthryl group, triphenylenyl group, chrysenyl group, fluorenylidene phenyl group, and 5H-dibenzo[a,d]cycloheptenylidene phenyl group;

(3) Non-condensed polycyclic groups such as biphenylyl group, terphenylyl group, and a group of the following formula:

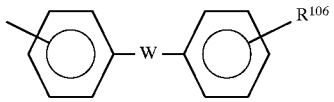

wherein W is —O—, —S—, —SO—, —$SO_2$—, —CO—, $-(CH_2)_c-$ in which c is an integer of 1 to 12, $-(CH{=}CH)_d-$ in which d is an integer of 1 to 3,

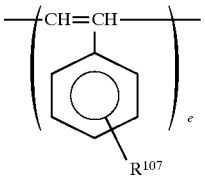

in which e is an integer of 1 to 3, or

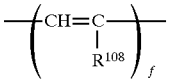

in which f is an integer of 1 to 3; and (4) Heterocyclic groups such as thienyl group, benzothienyl group, furyl group, benzofuranyl group and carbazolyl group.

As the arylene group represented by $Ar^1$, $Ar^2$ and $Ar^3$, there can be employed bivalent groups derived from the above-mentioned examples of the aryl group represented by $R^1$ and $R^2$.

The above-mentioned aryl group and arylene group may have a substituent. The above $R^{106}$, $R^{107}$ and $R^{108}$ also represent the same examples of such a substituent to be listed below.

Examples of such a substituent for $R^1$, $R^2$, $Ar^1$, $Ar^2$ and $Ar^3$ are as follows:

(1) A halogen atom, cyano group, and nitro group.

(2) An alkyl group, preferably a straight chain or branched alkyl group having 1 to 12 carbon atoms, more preferably having 1 to 8 carbon atoms, further preferably having 1 to 4 carbon atoms. The alkyl group may have a substituent such as a fluorine atom, hydroxyl group, cyano group, an alkoxyl group having 1 to 4 carbon atoms, or a phenyl group which may have a substituent selected from the group consisting of a halogen atom, an alkyl group having 1 to 4 carbon atoms, and an alkoxyl group having 1 to 4 carbon atoms.

Specific examples of such an alkyl group are methyl group, ethyl group, n-propyl group, i-propyl group, t-butyl group, s-butyl group, n-butyl group, i-butyl group, trifluoromethyl group, 2-hydroxyethyl group, 2-cyanoethyl group, 2-ethoxyethyl group, 2-methoxyethyl group, benzyl group, 4-chlorobenzyl group, 4-methylbenzyl group, 4-methoxybenzyl group, and 4-phenylbenzyl group.

(3) An alkoxyl group (—$OR^{109}$) in which $R^{109}$ is the same alkyl group as previously defined in (2).

Specific examples of such an alkoxyl group are methoxy group, ethoxy group, n-propoxy group, i-propoxy group, t-butoxy group, n-butoxy group, s-butoxy group, i-butoxy group, 2-hydroxyethoxy group, 2-cyanoethoxy group, benzyloxy group, 4-methylbenzyloxy group, and trifluoromethoxy group.

(4) An aryloxy group. Examples of the aryl group for use in the aryloxy group are phenyl group and naphthyl group. The aryloxy group may have a substituent such as an alkoxyl group having 1 to 4 carbon atoms, an alkyl group having 1 to 4 carbon atoms, or a halogen atom.

Specific examples of the aryloxy group are phenoxy group, 1-naphthyloxy group, 2-naphthyloxy group, 4-methylphenoxy group, 4-methoxyphenoxy group, 4-chlorophenoxy group, and 6-methyl-2-naphthyloxy group.

(5) A substituted mercapto group or an arylmercapto group. Specific examples of the substituted mercapto group and arylmercapto group include methylthio group, ethylthio group, phenylthio group, and p-methylphenylthio group.

(6) A group represented by the following formula:

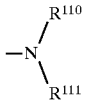

wherein $R^{110}$ and $R^{111}$ are each independently the same alkyl group as defined in (2) or an aryl group such as phenyl group, biphenyl group, or naphthyl group.

This group may have a substituent such as an alkoxyl group having 1 to 4 carbon atoms, an alkyl group having 1 to 4 carbon atoms or a halogen atom. $R^{110}$ and $R^{111}$ may form a ring in combination with the carbon atoms of the aryl group.

Specific examples of the above-mentioned group are diethylamino group, N-methyl-N-phenylamino group, N,N-diphenylamino group, N,N-di(p-tolyl)amino group, dibenzylamino group, piperidino group, morpholino group and julolidyl group.

(7) An alkylenedioxy group such as methylenedioxy group, and an alkylenedithio group such as methylenedithio group.

Furthermore, the above-mentioned charge transport material of formula (I) may be produced in such a manner that a diol compound having triarylamino group represented by the following formula (A) is subjected to polymerization by the phosgene method or ester interchange method using a diol compound of formula (B) in combination, so that X is introduced into the main chain of the obtained compound:

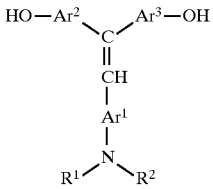

(A)

HO—X—OH (B)

wherein $Ar^1$ to $Ar^3$, $R^1$ and $R^2$ and X are the same as those previously defined.

In this case, the obtained polycarbonate resin is in the form of a random copolymer or block copolymer.

Alternatively, X can also be introduced into the repeat unit of the polycarbonate resin by the polymerization reaction of the diol compound of formula (A) and a bischloroformate derived from the diol compound of formula (B). In this case, the polycarbonate resin in the form of an alternating copolymer can be obtained.

Examples of the diol compound represented by formula (B) include aliphatic diols such as 1,3-propanediol, 1,4-butanediol, 1,5-pentanediol, 1,6-hexanediol, 1,8-octanediol, 1,10-decanediol, 2-methyl-1,3-propanediol, 2,2-dimethyl-1,3-propanediol, 2-ethyl-1,3-propanediol, diethylene glycol, triethylene glycol, polyethylene glycol and polytetramethylene ether glycol; and cyclic aliphatic diols such as 1,4-cyclohexanediol, 1,3-cyclohexanediol and cyclohexane-1,4-dimethanol.

Examples of the diol compound having an aromatic ring are as follows: 4,4'-dihydroxydiphenyl, bis(4-hydroxyphenyl)methane, 1,1-bis(4-hydroxyphenyl)ethane, 1,1-bis(4-hydroxyphenyl)-1-phenylethane, 2,2-bis(4-hydroxyphenyl)propane, 2,2-bis(3-methyl-4-hydroxyphenyl)propane, 1,1-bis(4-hydroxyphenyl)cyclohexane, 1,1-bis(4-hydroxyphenyl)cyclopentane, 2,2-bis(3-phenyl-4-hydroxyphenyl)propane, 2,2-bis(3-isopropyl-4-hydroxyphenyl)propane, 2,2-bis(4-hydroxyphenyl)butane, 2,2-bis(3,5-dimethyl-4-hydroxyphenyl)propane, 2,2-bis(3,5-dibromo-4-hydroxyphenyl)propane, 4,4'-dihydroxydiphenylsulfone, 4,4'-dihydroxydiphenylsulfoxide, 4,4'-dihydroxydiphenylsulfide, 3,3'-dimethyl-4,4'-dihydroxydiphenylsulfide, 4,4'-dihydroxydiphenyloxide, 2,2-bis(4-hydroxyphenyl)hexafluoropropane, 9,9-bis(4-hydroxyphenyl)fluorene, 9,9-bis(4-hydroxyphenyl)xanthene, ethylene glycol-bis(4-hydroxybenzoate), diethylene glycol-bis(4-hydroxybenzoate), triethylene glycol-bis(4-hydroxybenzoate), 1,3-bis(4-hydroxyphenyl)tetramethyl disiloxane, and phenol-modified silicone oil.

The charge transport material of formula (II) for use in the present invention will be explained in detail.

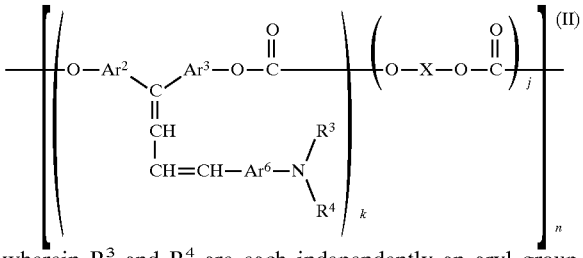

(II)

wherein $R^3$ and $R^4$ are each independently an aryl group which may have a substituent; $Ar^4$, $Ar^5$ and $Ar^6$, which may be the same or different, are each independently an arylene group; and k, j, n and X are the same as those previously defined in formula (I).

Examples of the aryl group represented by $R^3$ and $R^4$ are as follows:

(1) Aromatic hydrocarbon groups such as phenyl group;

(2) Condensed polycyclic groups such as naphthyl group, pyrenyl group, 2-fluorenyl group, 9,9-dimethyl-2-fluorenyl group, azurenyl group, anthryl group, triphenylenyl group, chrysenyl group, fluorenylidene phenyl group, and 5H-dibenzo[a,d]cycloheptenylidene phenyl group;

(3) Non-condensed polycyclic groups such as biphenylyl group and terphenylyl group; and (4) Heterocyclic groups such as thienyl group, benzothienyl group, furyl group, benzofuranyl group and carbazolyl group.

As the arylene group represented by $Ar^4$, $Ar^5$ and $Ar^6$ there can be employed bivalent groups derived from the above-mentioned examples of the aryl group represented by $R^3$ and $R^4$.

The above-mentioned aryl group and arylene group may have a substituent.

Examples of such a substituent for $R^3$, $R^4$, $Ar^4$, $Ar^5$ and $Ar^6$ are as follows:

(1) A halogen atom, cyano group, and nitro group.

(2) An alkyl group, preferably a straight chain or branched alkyl group having 1 to 12 carbon atoms, more preferably having 1 to 8 carbon atoms, further preferably having 1 to 4 carbon atoms. The alkyl group may have a substituent such as a fluorine atom, hydroxyl group, cyano group, an alkoxyl group having 1 to 4 carbon atoms, or a phenyl group which may have a substituent selected from the group consisting of a halogen atom, an alkyl group having 1 to 4 carbon atoms, and an alkoxyl group having 1 to 4 carbon atoms.

Specific examples of such an alkyl group are methyl group, ethyl group, n-propyl group, i-propyl group, t-butyl group, s-butyl group, n-butyl group, i-butyl group, trifluoromethyl group, 2-hydroxyethyl group, 2-cyanoethyl group, 2-ethoxyethyl group, 2-methoxyethyl group, benzyl group, 4-chlorobenzyl group, 4-methylbenzyl group, 4-methoxybenzyl group, and 4-phenylbenzyl group.

(3) An alkoxyl group (—$OR^{112}$) in which $R^{112}$ is the same alkyl group as previously defined in (2).

Specific examples of such an alkoxyl group are methoxy group, ethoxy group, n-propoxy group, i-propoxy group, t-butoxy group, n-butoxy group, s-butoxy group, i-butoxy group, 2-hydroxyethoxy group, 2-cyanoethoxy group, benzyloxy group, 4-methylbenzyloxy group, and trifluoromethoxy group.

(4) An aryloxy group. Examples of the aryl group for use in the aryloxy group are phenyl group and naphthyl group. The aryloxy group may have a substituent such as an alkoxyl group having 1 to 4 carbon atoms, an alkyl group having 1 to 4 carbon atoms, or a halogen atom.

Specific examples of the aryloxy group are phenoxy group, 1-naphthyloxy group, 2-naphthyloxy group, 4-methylphenoxy group, 4-methoxyphenoxy group, 4-chlorophenoxy group, and 6-methyl-2-naphthyloxy group.

(5) A substituted mercapto group or an arylmercapto group. Specific examples of the substituted mercapto group and arylmercapto group include methylthio group, ethylthio group, phenylthio group, and p-methylphenylthio group.

(6) An alkyl-substituted amino group. The same alkyl group as defined in (2) can be employed. Specific examples of the alkyl-substituted amino group are dimethylamino group, diethylamino group, N-methyl-N-propylamino group, and N,N-dibenzylamino group.

(7) An acyl group such as acetyl group, propionyl group, butyryl group, malonyl group and benzoyl group.

Furthermore, the above-mentioned charge transport material of formula (II) may be produced in such a manner that a diol compound having triarylamino group represented by the following formula (C) is subjected to polymerization by the phosgene method or ester interchange method using a diol compound of formula (B) in combination, so that X is introduced into the main chain of the obtained compound:

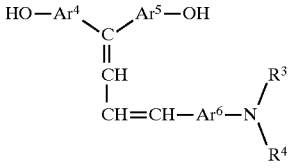

(C)

HO—X—OH (B)

wherein $Ar^4$ to $Ar^6$, $R^3$ and $R^4$ and X are the same as those previously defined.

In this case, the obtained polycarbonate resin is in the form of a randam copolymer or block copolymer.

Alternatively, X can also be introduced into the repeat unit of the polycarbonate resin by the polymerization reaction of the diol compound of formula (C) and a bischloroformate derived from the diol compound of formula (B). In this case, the polycarbonate resin in the form of an alternating copolymer can be obtained.

The same diol compounds as mentioned in formula (I) can also be employed as the diol compound of formula (B).

The charge transport material of formula (III) for use in the present invention will be explained in detail.

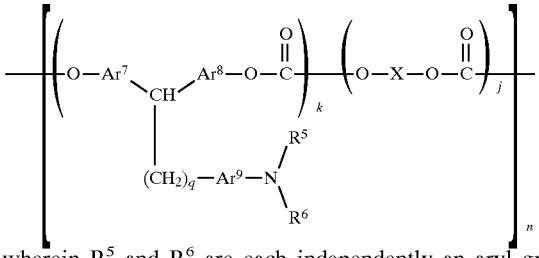

(III)

wherein $R^5$ and $R^6$ are each independently an aryl group which may have a substituent; $Ar^7$, $Ar^8$ and $Ar^9$, which may be the same or different, are each independently an arylene group; q is an integer of 1 to 5; and k, j, n and X are the same as those previously defined in formula (I).

Examples of the aryl group represented by $R^5$ and $R^6$ are as follows:

(1) Aromatic hydrocarbon groups such as phenyl group;

(2) Condensed polycyclic groups such as naphthyl group, pyrenyl group, 2-fluorenyl group, 9,9-dimethyl-2-fluorenyl group, azurenyl group, anthryl group, triphenylenyl group, chrysenyl group, fluorenylidene phenyl group, and 5H-dibenzo[a,d]cycloheptenylidene phenyl group;

(3) Non-condensed polycyclic groups such as biphenylyl group and terphenylyl group; and (4) Heterocyclic groups such as thienyl group, benzothienyl group, furyl group, benzofuranyl group and carbazolyl group.

As the arylene group represented by $Ar^7$, $Ar^8$ and $Ar^9$, there can be employed bivalent groups derived from the above-mentioned examples of the aryl group represented by $R^5$ and $R^6$.

The above-mentioned aryl group and arylene group may have a substituent.

Examples of such a substituent for $R^5$, $R^6$, $Ar^7$, $Ar^8$ and $Ar^9$ are as follows:

(1) A halogen atom, cyano group, and nitro group.

(2) An alkyl group, preferably a straight chain or branched alkyl group having 1 to 12 carbon atoms, more preferably having 1 to 8 carbon atoms, further preferably having 1 to 4 carbon atoms. The alkyl group may have a substituent such as a fluorine atom, hydroxyl group, cyano group, an alkoxyl group having 1 to 4 carbon atoms, or a phenyl group which may have a substituent selected from the group consisting of a halogen atom, an alkyl group having 1 to 4 carbon atoms, and an alkoxyl group having 1 to 4 carbon atoms.

Specific examples of such an alkyl group are methyl group, ethyl group, n-propyl group, i-propyl group, t-butyl group, s-butyl group, n-butyl group, i-butyl group, trifluoromethyl group, 2-hydroxyethyl group, 2-cyanoethyl group, 2-ethoxyethyl group, 2-methoxyethyl group, benzyl group, 4-chlorobenzyl group, 4-methylbenzyl group, 4-methoxybenzyl group, and 4-phenylbenzyl group.

(3) An alkoxyl group (—$OR^{113}$) in which $R^{113}$ is the same alkyl group as previously defined in (2).

Specific examples of such an alkoxyl group are methoxy group, ethoxy group, n-propoxy group, i-propoxy group, t-butoxy group, n-butoxy group, s-butoxy group, i-butoxy group, 2-hydroxyethoxy group, 2-cyanoethoxy group, benzyloxy group, 4-methylbenzyloxy group, and trifluoromethoxy group.

(4) An aryloxy group. Examples of the aryl group for use in the aryloxy group are phenyl group and naphthyl group. The aryloxy group may have a substituent such as an alkoxyl group having 1 to 4 carbon atoms, an alkyl group having 1 to 4 carbon atoms, or a halogen atom.

Specific examples of the aryloxy group are phenoxy group, 1-naphthyloxy group, 2-naphthyloxy group, 4-methylphenoxy group, 4-methoxyphenoxy group, 4-chlorophenoxy group, and 6-methyl-2-naphthyloxy group.

(5) A substituted mercapto group or an arylmercapto group. Specific examples of the substituted mercapto group and arylmercapto group include methylthio group, ethylthio group, phenylthio group, and p-methylphenylthio group.

(6) An alkyl-substituted amino group. The same alkyl group as defined in (2) can be employed.

Specific examples of the alkyl-substituted amino group are dimethylamino group, diethylamino group, N-methyl-N-propylamino group, and N,N-dibenzylamino group.

(7) An acyl group such as acetyl group, propionyl group, butyryl group, malonyl group and benzoyl group.

Furthermore, the above-mentioned charge transport material of formula (III) may be produced in such a manner that a diol compound having triarylamino group represented by the following formula (D) is subjected to polymerization by the phosgene method or ester interchange method using a diol compound of formula (B) in combination, so that X is introduced into the main chain of the obtained compound:

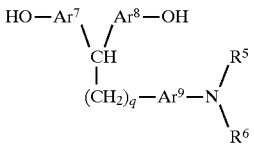

(D)

$$HO-X-OH \quad (B)$$

wherein $Ar^7$ to $Ar^9$, $R^5$ and $R^6$, q and X are the same as those previously defined.

In this case, the obtained polycarbonate resin is in the form of a randam copolymer or block copolymer.

Alternatively, X can also be introduced into the repeat unit of the polycarbonate resin by the polymerization reaction of the diol compound of formula (D) and a bischloroformate derived from the diol compound of formula (B). In this case, the polycarbonate resin in the form of an alternating copolymer can be obtained.

The same diol compounds as mentioned in formula (I) can also be employed as the diol compound of formula (B).

The charge transport material of formula (IV) for use in the present invention will be explained in detail.

wherein $R^7$ and $R^8$ are each independently an aryl group which may have a substituent; $Ar^{10}$, $Ar^{11}$ and $Ar^{12}$, which may be the same or different, are each independently an arylene group; $X^1$ and $X^2$ are each independently ethylene group which may have a substituent or vinylene group which may have a substituent; and k, j, n and X are the same as those previously defined in formula (I).

Examples of the aryl group represented by $R^7$ and $R^8$ are as follows:

(1) Aromatic hydrocarbon groups such as phenyl group;

(2) Condensed polycyclic groups such as naphthyl group, pyrenyl group, 2-fluorenyl group, 9,9-dimethyl-2-fluorenyl group, azurenyl group, anthryl group, triphenylenyl group, chrysenyl group, fluorenylidene phenyl group, and 5H-dibenzo[a,d]cycloheptenylidene phenyl group;

(3) Non-condensed polycyclic groups such as biphenylyl group and terphenylyl group; and (4) Heterocyclic groups such as thienyl group, benzothienyl group, furyl group, benzofuranyl group and carbazolyl group.

As the arylene group represented by $Ar^{10}$, $Ar^{11}$ and $Ar^{12}$, there can be employed bivalent groups derived from the above-mentioned examples of the aryl group represented by $R^7$ and $R^8$.

The above-mentioned aryl group and arylene group may have a substituent.

Examples of such a substituent for $R^7$, $R^8$, $Ar^{10}$, $Ar^{11}$ and $Ar^{12}$ are as follows:

(1) A halogen atom, cyano group, and nitro group.

(2) An alkyl group, preferably a straight chain or branched alkyl group having 1 to 12 carbon atoms, more preferably having 1 to 8 carbon atoms, further preferably having 1 to 4 carbon atoms. The alkyl group may have a substituent such as a fluorine atom, hydroxyl group, cyano group, an alkoxyl group having 1 to 4 carbon atoms, or a phenyl group which may have a substituent selected from the group consisting of a halogen atom, an alkyl group having 1 to 4 carbon atoms, and an alkoxyl group having 1 to 4 carbon atoms.

Specific examples of such an alkyl group are methyl group, ethyl group, n-propyl group, i-propyl group, t-butyl group, s-butyl group, n-butyl group, i-butyl group, trifluoromethyl group, 2-hydroxyethyl group, 2-cyanoethyl group, 2-ethoxyethyl group, 2-methoxyethyl group, benzyl group, 4-chlorobenzyl group, 4-methylbenzyl group, 4-methoxybenzyl group, and 4-phenylbenzyl group.

(3) An alkoxyl group (—$OR^{114}$) in which $R^{114}$ is the same alkyl group as previously defined in (2).

Specific examples of such an alkoxyl group are methoxy group, ethoxy group, n-propoxy group, i-propoxy group, t-butoxy group, n-butoxy group, s-butoxy group, i-butoxy group, 2-hydroxyethoxy group, 2-cyanoethoxy group, benzyloxy group, 4-methylbenzyloxy group, and trifluoromethoxy group.

(4) An aryloxy group. Examples of the aryl group for use in the aryloxy group are phenyl group and naphthyl group. The aryloxy group may have a substituent such as an alkoxyl

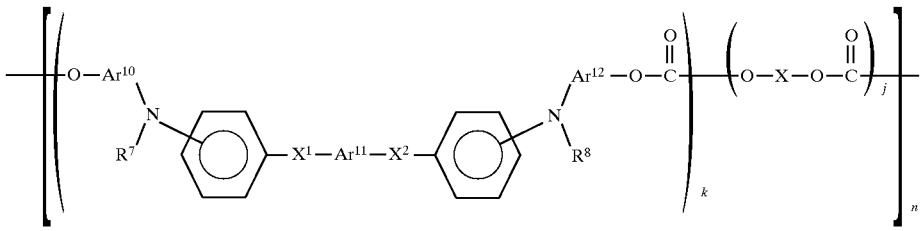

(IV)

group having 1 to 4 carbon atoms, an alkyl group having 1 to 4 carbon atoms, or a halogen atom.

Specific examples of the aryloxy group are phenoxy group, 1-naphthyloxy group, 2-naphthyloxy group, 4-methylphenoxy group, 4-methoxyphenoxy group, 4-chlorophenoxy group, and 6-methyl-2-naphthyloxy group.

(5) A substituted mercapto group or an arylmercapto group. Specific examples of the substituted mercapto group and arylmercapto group include methylthio group, ethylthio group, phenylthio group, and p-methylphenylthio group.

(6) An alkyl-substituted amino group. The same alkyl group as defined in (2) can be employed. Specific examples of the alkyl-substituted amino group are dimethylamino group, diethylamino group, N-methyl-N-propylamino group, and N,N-dibenzylamino group.

(7) An acyl group such as acetyl group, propionyl group, butyryl group, malonyl group and benzoyl group.

Examples of the substituent for $X^1$ and $X^2$ which are each independently ethylene group or vinylene group include cyano group, a halogen atom, nitro group, the same aryl group as mentioned in $R^7$ and $R^8$, and the same alkyl group as mentioned in the substituent (2) for $R^7$, $R^8$, $Ar^{10}$, $Ar^{11}$ and $Ar^{12}$.

Furthermore, the above-mentioned charge transport material of formula (IV) may be produced in such a manner that a diol compound having triarylamino group represented by the following formula (E) is subjected to polymerization by the phosgene method or ester interchange method using a diol compound of formula (B) in combination, so that X is introduced into the main chain of the obtained compound:

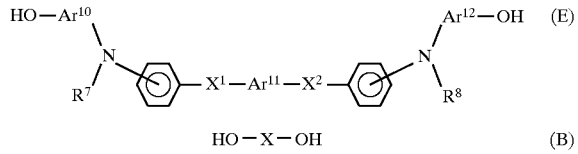

(E)

(B)

wherein $Ar^{10}$ to $Ar^{12}$, $R^7$ and $R^8$, $X^1$ and $X^2$, and X are the same as those previously defined.

In this case, the obtained polycarbonate resin is in the form of a randam copolymer or block copolymer.

Alternatively, X can also be introduced into the repeat unit of the polycarbonate resin by the polymerization reaction of the diol compound of formula (E) and a bischloroformate derived from the diol compound of formula (B). In this case, the polycarbonate resin in the form of an alternating copolymer can be obtained.

The same diol compounds as mentioned in formula (I) can also be employed as the diol compound of formula (B).

The charge transport material of formula (V) for use in the present invention will be explained in detail.

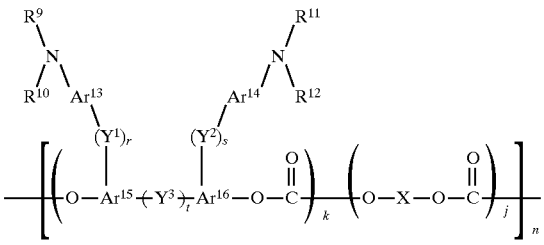

(V)

wherein $R^9$ to $R^{12}$ are each independently an aryl group which may have a substituent; $Ar^{13}$ to $Ar^{16}$, which may be the same or different, are each independently an arylene group; r, s and t are each an integer of 0 or 1, and when r, s and t are each 1, $Y^1$ to $Y^3$ are each independently an alkylene group which may have a substituent, a cycloalkylene group which may have a substituent, an alkylene ether group which may have a substituent, oxygen atom, sulfur atom, or vinylene group; and k, j, n and X are the same as those previously defined in formula (I).

Examples of the aryl group represented by $R^9$ to $R^{12}$ are as follows:

(1) Aromatic hydrocarbon groups such as phenyl group;

(2) Condensed polycyclic groups such as naphthyl group, pyrenyl group, 2-fluorenyl group, 9,9-dimethyl-2-fluorenyl group, azurenyl group, anthryl group, triphenylenyl group, chrysenyl group, fluorenylidene phenyl group, and 5H-dibenzo[a,d]cycloheptenylidene phenyl group;

(3) Non-condensed polycyclic groups such as biphenylyl group and terphenylyl group; and (4) Heterocyclic groups such as thienyl group, benzothienyl group, furyl group, benzofuranyl group and carbazolyl group.

As the arylene group represented by $Ar^{13}$ to $Ar^{16}$, there can be employed bivalent groups derived from the above-mentioned examples of the aryl group represented by $R^9$ to $R^{12}$.

The above-mentioned aryl group and arylene group may have a substituent.

Examples of such a substituent for $R^9$ to $R^{12}$ and $Ar^{13}$ to $Ar^{16}$ are as follows:

(1) A halogen atom, cyano group, and nitro group.

(2) An alkyl group, preferably a straight chain or branched alkyl group having 1 to 12 carbon atoms, more preferably having 1 to 8 carbon atoms, further preferably having 1 to 4 carbon atoms. The alkyl group may have a substituent such as a fluorine atom, hydroxyl group, cyano group, an alkoxyl group having 1 to 4 carbon atoms, or a phenyl group which may have a substituent selected from the group consisting of a halogen atom, an alkyl group having 1 to 4 carbon atoms, and an alkoxyl group having 1 to 4 carbon atoms.

Specific examples of such an alkyl group are methyl group, ethyl group, n-propyl group, i-propyl group, t-butyl group, s-butyl group, n-butyl group, i-butyl group, trifluoromethyl group, 2-hydroxyethyl group, 2-cyanoethyl group, 2-ethoxyethyl group, 2-methoxyethyl group, benzyl group, 4-chlorobenzyl group, 4-methylbenzyl group, 4-methoxybenzyl group, and 4-phenylbenzyl group.

(3) An alkoxyl group (—$OR^{115}$) in which $R^{115}$ is the same alkyl group as previously defined in (2).

Specific examples of such an alkoxyl group are methoxy group, ethoxy group, n-propoxy group, i-propoxy group, t-butoxy group, n-butoxy group, s-butoxy group, i-butoxy group, 2-hydroxyethoxy group, 2-cyanoethoxy group, benzyloxy group, 4-methylbenzyloxy group, and trifluoromethoxy group.

(4) An aryloxy group. Examples of the aryl group for use in the aryloxy group are phenyl group and naphthyl group. The aryloxy group may have a substituent such as an alkoxyl group having 1 to 4 carbon atoms, an alkyl group having 1 to 4 carbon atoms, or a halogen atom.

Specific examples of the aryloxy group are phenoxy group, 1-naphthyloxy group, 2-naphthyloxy group, 4-methylphenoxy group, 4-methoxyphenoxy group, 4-chlorophenoxy group, and 6-methyl-2-naphthyloxy group.

When $Y^1$ to $Y^3$ are each independently an alkylene group, there can be employed bivalent groups derived from the above-mentioned alkyl group (2).

Specific examples of the alkylene group represented by $Y^1$ to $Y^3$ are methylene group, ethylene group, 1,3-propylene group, 1,4-butylene group, 2-methyl-1,3-propylene group, difluoromethylene group, hydroxyethylene group, cyanoethylene group, methoxyethylene group, phenylmethylene group, 4-methylphenylmethylene group, 2,2-propylene group, 2,2-butylene group and diphenylmethylene group.

Examples of the cycloalkylene group represented by $Y^1$ to $Y^3$ are 1,1-cyclopentylene group, 1,1-cyclohexylene group and 1,1-cyclooctylene group.

Examples of the alkylene ether group represented by $Y^1$ to $Y^3$ are dimethylene ether group, diethylene ether group, ethylene methylene ether group, bis(triethylene)ether group, and polytetramethylene ether group.

Furthermore, the above-mentioned charge transport material of formula (V) may be produced in such a manner that a diol compound having triarylamino group represented by the following formula (F) is subjected to polymerization by the phosgene method or ester interchange method using a diol compound of formula (B) in combination, so that X is introduced into the main chain of the obtained compound:

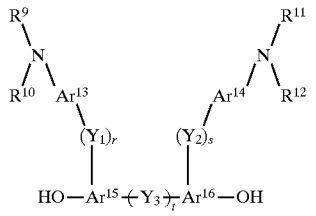

(F)

$$HO-X-OH \quad (B)$$

wherein $Ar^{13}$ to $Ar^{16}$, $R^9$ to $R^{12}$, $Y^1$ to $Y^3$, r, s, t, and X are the same as those previously defined.

In this case, the obtained polycarbonate resin is in the form of a random copolymer or block copolymer.

Alternatively, X can also be introduced into the repeat unit of the polycarbonate resin by the polymerization reaction of the diol compound of formula (F) and a bischloroformate derived from the diol compound of formula (B). In this case, the polycarbonate resin in the form of an alternating copolymer can be obtained.

The same diol compounds as mentioned in formula (I) can also be employed as the diol compound of formula (B).

The charge transport material of formula (VI) for use in the present invention will be explained in detail.

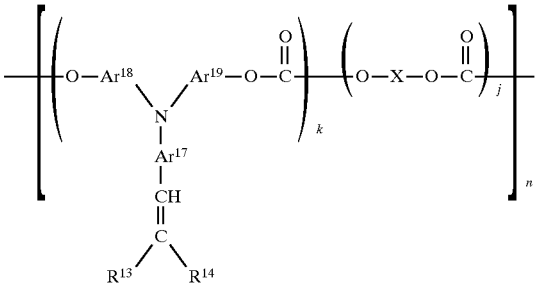

(VI)

wherein $R^{13}$ and $R^{14}$ are each independently a hydrogen atom or an aryl group which may have a substituent, and $R^{13}$ and $R^{14}$ may form a ring in combination; $Ar^{17}$, $Ar^{18}$ and $Ar^{19}$, which may be the same or different, are each independently an arylene group; and k, j, n and X are the same as those previously defined in formula (I).

Examples of the aryl group represented by $R^{13}$ and $R^{14}$ are as follows:

(1) Aromatic hydrocarbon groups such as phenyl group;

(2) Condensed polycyclic groups such as naphthyl group, pyrenyl group, 2-fluorenyl group, 9,9-dimethyl-2-fluorenyl group, azurenyl group, anthryl group, triphenylenyl group, chrysenyl group, fluorenylidene phenyl group, and 5H-dibenzo[a,d]cycloheptenylidene phenyl group;

(3) Non-condensed polycyclic groups such as biphenylyl group and terphenylyl group; and (4) Heterocyclic groups such as thienyl group, benzothienyl group, furyl group, benzofuranyl group and carbazolyl group.

In addition, $R^{13}$ and $R^{14}$ may form a ring such as 9-fluorenylidene or 5H-dibenzo[a,d]cycloheptenylidene.

As the arylene group represented by $Ar^{17}$, $Ar^{18}$ and $Ar^{19}$, there can be employed bivalent groups derived from the above-mentioned examples of the aryl group represented by $R^{13}$ and $R^{14}$.

The above-mentioned aryl group and arylene group may have a substituent.

Examples of such a substituent for $R^{13}$, $R^{14}$, $Ar^{17}$, $Ar^{18}$ and $Ar^{19}$ are as follows:

(1) A halogen atom, cyano group, and nitro group.

(2) An alkyl group, preferably a straight chain or branched alkyl group having 1 to 12 carbon atoms, more preferably having 1 to 8 carbon atoms, further preferably having 1 to 4 carbon atoms. The alkyl group may have a substituent such as a fluorine atom, hydroxyl group, cyano group, an alkoxyl group having 1 to 4 carbon atoms, or a phenyl group which may have a substituent selected from the group consisting of a halogen atom, an alkyl group having 1 to 4 carbon atoms, and an alkoxyl group having 1 to 4 carbon atoms.

Specific examples of such an alkyl group are methyl group, ethyl group, n-propyl group, i-propyl group, t-butyl group, s-butyl group, n-butyl group, i-butyl group, trifluoromethyl group, 2-hydroxyethyl group, 2-cyanoethyl group, 2-ethoxyethyl group, 2-methoxyethyl group, benzyl group, 4-chlorobenzyl group, 4-methylbenzyl group, 4-methoxybenzyl group, and 4-phenylbenzyl group.

(3) An alkoxyl group (—$OR^{116}$) in which $R^{116}$ is the same alkyl group as previously defined in (2).

Specific examples of such an alkoxyl group are methoxy group, ethoxy group, n-propoxy group, i-propoxy group, t-butoxy group, n-butoxy group, s-butoxy group, i-butoxy group, 2-hydroxyethoxy group, 2-cyanoethoxy group, benzyloxy group, 4-methylbenzyloxy group, and trifluoromethoxy group.

(4) An aryloxy group. Examples of the aryl group for use in the aryloxy group are phenyl group and naphthyl group. The aryloxy group may have a substituent such as an alkoxyl group having 1 to 4 carbon atoms, an alkyl group having 1 to 4 carbon atoms, or a halogen atom.

Specific examples of the aryloxy group are phenoxy group, 1-naphthyloxy group, 2-naphthyloxy group, 4-methylphenoxy group, 4-methoxyphenoxy group, 4-chlorophenoxy group, and 6-methyl-2-naphthyloxy group.

(5) A substituted mercapto group or an arylmercapto group. Specific examples of the substituted mercapto group and arylmercapto group include methylthio group, ethylthio group, phenylthio group, and p-methylphenylthio group.

(6) An alkyl-substituted amino group. The same alkyl group as defined in (2) can be employed. Specific examples of the alkyl-substituted amino group are dimethylamino group, diethylamino group, N-methyl-N-propylamino group, and N,N-dibenzylamino group.

(7) An acyl group such as acetyl group, propionyl group, butyryl group, malonyl group and benzoyl group.

Furthermore, the above-mentioned charge transport material of formula (VI) may be produced in such a manner that a diol compound having triarylamino group represented by the following formula (G) is subjected to polymerization by the phosgene method or ester interchange method using a diol compound of formula (B) in combination, so that X is introduced into the main chain of the obtained compound:

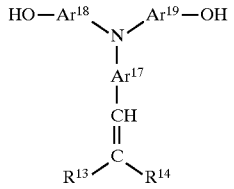

(G)

$$HO-X-OH \quad (B)$$

wherein $Ar^{17}$ to $Ar^{19}$, $R^{13}$ and $R^{14}$, and X are the same as those previously defined.

In this case, the obtained polycarbonate resin is in the form of a random copolymer or block copolymer.

Alternatively, X can also be introduced into the repeat unit of the polycarbonate resin by the polymerization reaction of the diol compound of formula (G) and a bischloroformate derived from the diol compound of formula (B). In this case, the polycarbonate resin in the form of an alternating copolymer can be obtained.

The same diol compounds as mentioned in formula (I) can also be employed as the diol compound of formula (B).

The charge transport material of formula (VII) for use in the present invention will be explained in detail.

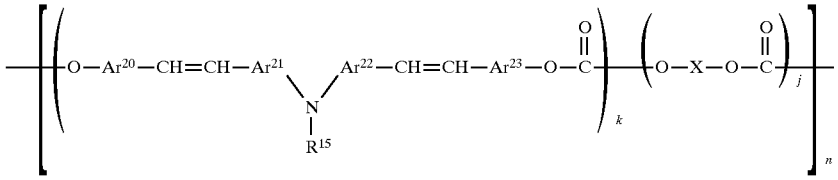

(VII)

wherein $R^{15}$ is an aryl group which may have a substituent; $Ar^{20}$ to $Ar^{23}$, which may be the same or different, are each independently an arylene group; and k, j, n and X are the same as those previously defined in formula (I).

Examples of the aryl group represented by $R^{15}$ are as follows:

(1) Aromatic hydrocarbon groups such as phenyl group;

(2) Condensed polycyclic groups such as naphthyl group, pyrenyl group, 2-fluorenyl group, 9,9-dimethyl-2-fluorenyl group, azurenyl group, anthryl group, triphenylenyl group, chrysenyl group, fluorenylidene phenyl group, and 5H-dibenzo[a,d]cycloheptenylidene phenyl group;

(3) Non-condensed polycyclic groups such as biphenylyl group and terphenylyl group; and (4) Heterocyclic groups such as thienyl group, benzothienyl group, furyl group, benzofuranyl group and carbazolyl group.

As the arylene group represented by $Ar^{20}$ to $Ar^{23}$, there can be employed bivalent groups derived from the above-mentioned examples of the aryl group represented by $R^{15}$.

The above-mentioned aryl group and arylene group may have a substituent.

Examples of such a substituent for $R^{15}$, $Ar^{20}$, $Ar^{21}$, $Ar^{22}$, and $Ar^{23}$ are as follows:

(1) A halogen atom, cyano group, and nitro group.

(2) An alkyl group, preferably a straight chain or branched alkyl group having 1 to 12 carbon atoms, more preferably having 1 to 8 carbon atoms, further preferably having 1 to 4 carbon atoms. The alkyl group may have a substituent such as a fluorine atom, hydroxyl group, cyano group, an alkoxyl group having 1 to 4 carbon atoms, or a phenyl group which may have a substituent selected from the group consisting of a halogen atom, an alkyl group having 1 to 4 carbon atoms, and an alkoxyl group having 1 to 4 carbon atoms.

Specific examples of such an alkyl group are methyl group, ethyl group, n-propyl group, i-propyl group, t-butyl group, s-butyl group, n-butyl group, i-butyl group, trifluoromethyl group, 2-hydroxyethyl group, 2-cyanoethyl group, 2-ethoxyethyl group, 2-methoxyethyl group, benzyl group, 4-chlorobenzyl group, 4-methylbenzyl group, 4-methoxybenzyl group, and 4-phenylbenzyl group.

(3) An alkoxyl group (—$OR^{117}$) in which $R^{117}$ is the same alkyl group as previously defined in (2).

Specific examples of such an alkoxyl group are methoxy group, ethoxy group, n-propoxy group, i-propoxy group, t-butoxy group, n-butoxy group, s-butoxy group, i-butoxy group, 2-hydroxyethoxy group, 2-cyanoethoxy group, benzyloxy group, 4-methylbenzyloxy group, and trifluoromethoxy group.

(4) An aryloxy group. Examples of the aryl group for use in the aryloxy group are phenyl group and naphthyl group. The aryloxy group may have a substituent such as an alkoxyl group having 1 to 4 carbon atoms, an alkyl group having 1 to 4 carbon atoms, or a halogen atom.

Specific examples of the aryloxy group are phenoxy group, 1-naphthyloxy group, 2-naphthyloxy group, 4-methylphenoxy group, 4-methoxyphenoxy group, 4-chlorophenoxy group, and 6-methyl-2-naphthyloxy group.

(5) A substituted mercapto group or an arylmercapto group. Specific examples of the substituted mercapto group and arylmercapto group include methylthio group, ethylthio group, phenylthio group, and p-methylphenylthio group.

(6) An alkyl-substituted amino group. The same alkyl group as defined in (2) can be employed. Specific examples of the alkyl-substituted amino group are dimethylamino group, diethylamino group, N-methyl-N-propylamino group, and N,N-dibenzylamino group.

(7) An acyl group such as acetyl group, propionyl group, butyryl group, malonyl group and benzoyl group.

Furthermore, the above-mentioned charge transport material of formula (VII) may be produced in such a manner that a diol compound having triarylamino group represented by the following formula (H) is subjected to polymerization by the phosgene method or ester interchange method using a diol compound of formula (B) in combination, so that X is introduced into the main chain of the obtained compound:

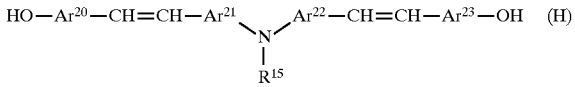

(H)

$$HO-X-OH \quad (B)$$

wherein $Ar^{20}$ to $Ar^{23}$, $R^{15}$, and X are the same as those previously defined.

In this case, the obtained polycarbonate resin is in the form of a random copolymer or block copolymer.

Alternatively, X can also be introduced into the repeat unit of the polycarbonate resin by the polymerization reaction of the diol compound of formula (H) and a bischloroformate derived from the diol compound of formula (B). In this case, the polycarbonate resin in the form of an alternating copolymer can be obtained.

The same diol compounds as mentioned in formula (I) can also be employed as the diol compound of formula (B).

The charge transport material of formula (VIII) for use in the present invention will be explained in detail.

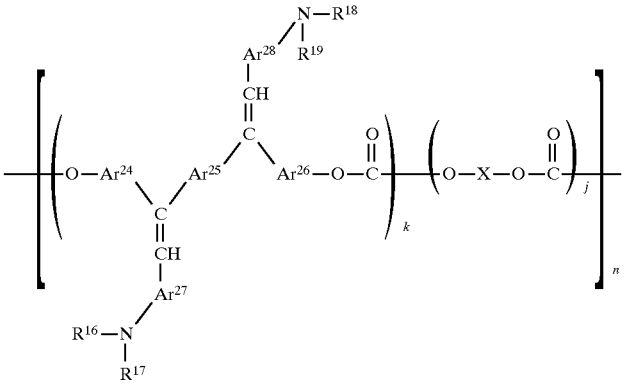

(VIII)

wherein $R^{16}$ to $R^{19}$ are each independently an aryl group which may have a substituent; $Ar^{24}$ to $Ar^{28}$, which may be the same or different, are each independently an arylene group; and k, j, n and X are the same as those previously defined in formula (I).

Examples of the aryl group represented by $R^{16}$ to $R^{19}$ are as follows:

(1) Aromatic hydrocarbon groups such as phenyl group;

(2) Condensed polycyclic groups such as naphthyl group, pyrenyl group, 2-fluorenyl group, 9,9-dimethyl-2-fluorenyl group, azurenyl group, anthryl group, triphenylenyl group, chrysenyl group, fluorenylidene phenyl group, and 5H-dibenzo[a,d]cycloheptenylidene phenyl group;

(3) Non-condensed polycyclic groups such as biphenylyl group and terphenylyl group; and (4) Heterocyclic groups such as thienyl group, benzothienyl group, furyl group, benzofuranyl group and carbazolyl group.

As the arylene group represented by $Ar^{24}$ to $Ar^{28}$, there can be employed bivalent groups derived from the above-mentioned examples of the aryl group represented by $R^{16}$ to $R^{19}$.

The above-mentioned aryl group and arylene group may have a substituent.

Examples of such a substituent for $R^{16}$ to $R^{19}$ and $Ar^{24}$ to $Ar^{28}$ are as follows:

(1) A halogen atom, cyano group, and nitro group.

(2) An alkyl group, preferably a straight chain or branched alkyl group having 1 to 12 carbon atoms, more preferably having 1 to 8 carbon atoms, further preferably having 1 to 4 carbon atoms. The alkyl group may have a substituent such as a fluorine atom, hydroxyl group, cyano group, an alkoxyl group having 1 to 4 carbon atoms, or a phenyl group which may have a substituent selected from the group consisting of a halogen atom, an alkyl group having 1 to 4 carbon atoms, and an alkoxyl group having 1 to 4 carbon atoms.

Specific examples of such an alkyl group are methyl group, ethyl group, n-propyl group, i-propyl group, t-butyl group, s-butyl group, n-butyl group, i-butyl group, trifluoromethyl group, 2-hydroxyethyl group, 2-cyanoethyl group, 2-ethoxyethyl group, 2-methoxyethyl group, benzyl group, 4-chlorobenzyl group, 4-methylbenzyl group, 4-methoxybenzyl group, and 4-phenylbenzyl group.

(3) An alkoxyl group (—$OR^{118}$) in which $R^{118}$ is the same alkyl group as previously defined in (2).

Specific examples of such an alkoxyl group are methoxy group, ethoxy group, n-propoxy group, i-propoxy group, t-butoxy group, n-butoxy group, s-butoxy group, i-butoxy group, 2-hydroxyethoxy group, 2-cyanoethoxy group, benzyloxy group, 4-methylbenzyloxy group, and trifluoromethoxy group.

(4) An aryloxy group. Examples of the aryl group for use in the aryloxy group are phenyl group and naphthyl group. The aryloxy group may have a substituent such as an alkoxyl group having 1 to 4 carbon atoms, an alkyl group having 1 to 4 carbon atoms, or a halogen atom.

Specific examples of the aryloxy group are phenoxy group, 1-naphthyloxy group, 2-naphthyloxy group, 4-methylphenoxy group, 4-methoxyphenoxy group, 4-chlorophenoxy group, and 6-methyl-2-naphthyloxy group.

(5) A substituted mercapto group or an arylmercapto group. Specific examples of the substituted mercapto group and arylmercapto group include methylthio group, ethylthio group, phenylthio group, and p-methylphenylthio group.

(6) An alkyl-substituted amino group. The same alkyl group as defined in (2) can be employed. Specific examples of the alkyl-substituted amino group are dimethylamino group, diethylamino group, N-methyl-N-propylamino group, and N,N-dibenzylamino group.

(7) An acyl group such as acetyl group, propionyl group, butyryl group, malonyl group and benzoyl group.

Furthermore, the above-mentioned charge transport material of formula (VIII) may be produced in such a manner that a diol compound having triarylamino group represented by the following formula (J) is subjected to polymerization by the phosgene method or ester interchange method using a diol compound of formula (B) in combination, so that X is introduced into the main chain of the obtained compound:

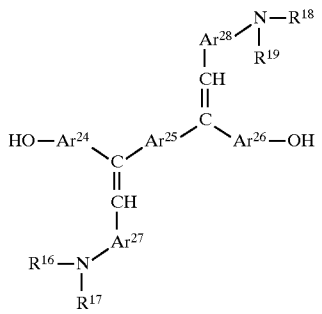

(J)

HO—X—OH (B)

wherein $Ar^{24}$ to $Ar^{28}$, $R^{16}$ to $R^{19}$, and X are the same as those previously defined.

In this case, the obtained polycarbonate resin is in the form of a random copolymer or block copolymer.

Alternatively, X can also be introduced into the repeat unit of the polycarbonate resin by the polymerization reaction of the diol compound of formula (J) and a bischloroformate derived from the diol compound of formula (B). In this case, the polycarbonate resin in the form of an alternating copolymer can be obtained.

The same diol compounds as mentioned in formula (I) can also be employed as the diol compound of formula (B).

The electroconductive support 21 of the photoconductor according to the present invention may exhibit electroconductive properties, and have a volume resistivity of $10^{10}$ Ω·cm or less. The electroconductive support 21 can be prepared by coating a plastic film or a sheet of paper, which may be in the cylindrical form, with metals such as aluminum, nickel, chromium, nichrome, copper, silver, gold, platinum and iron, or metallic oxides such as tin oxide and indium oxide by the vacuum deposition or sputtering method. Alternatively, a sheet of aluminum, aluminum alloys, nickel, or stainless steel may be formed into a tube by the drawing and ironing (D.I.) method, the impact ironing (I.I.) method, the extrusion method or the pultrusion method. Subsequently, the tube thus obtained may be subjected to surface treatment such as cutting, superfinishing or abrasion to prepare the electroconductive support 21 for use in the photoconductor of the present invention.

The photoconductive layer 23 for use in the present invention may be of a single-layered type as shown in FIG. 1, or a laminated type as shown in FIG. 2 or 3.

When the laminated-type photoconductive layer 23 is employed, the charge generation layer 31 comprises a charge generation material with a phthalocyanine structure as shown in the following formula (K):

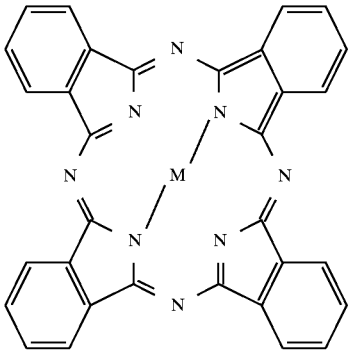

(K)

In the above formula (K), M (central atom) is a metal atom or hydrogen atom.

To be more specific, as the central atom (M) in the formula (K), there can be employed an atom of H, Li, Be, Na, Mg, Al, Si, K, Ca, Sc, Ti, V, Cr, Mn, Fe, Co, Ni, Cu, Zn, Ga, Ge, Y, Zr, Nb, Mo, Tc, Ru, Rh, Pd, Ag, Cd, In, Sn, Sb, Ba, Hf, Ta, W, Re, Os, Ir, Pt, Au, Hg, Tl, La, Ce, Pr, Nd, Pm, Sm, Eu, Gd, Tb, Dy, Ho, Er, Tm, Yb, Lu, Th, Pa, U, Np or Am; the combination of atoms of an oxide, chloride, fluoride, hydroxide or bromide. The central atom is not limited to the above-mentioned atoms.

The charge generation material with a phthalocyanine structure for use in the present invention may have at least the above-mentioned basic structure as shown in formula (K). Therefore, the charge generation material may have a dimer structure or trimer structure, and further, a polymeric structure. Further, the above-mentioned basic structure of formula (K) may have a substituent.

Of the phthalocyanine compounds thus obtained, an oxotitanium phthalocyanine compound which has the central atom (M) of TiO in the formula (K) and a metal-free phthalocyanine compound which has a hydrogen atom as the central atom (M) are particularly preferred in the present invention because the obtained photoconductors show excellent photoconductive properties.

In addition, it is known that each phthalocyanine compound has a variety of crystal systems. For example, the above-mentioned oxotitanium phthalocyanine has crystal systems of α-type, β-type, γ-type, m-type, and γ-type. In the case of copper phthalocyanine, there are crystal systems of α-type, β-type, and y-type. The properties of the phthalocyanine compound vary depending on the crystal system thereof although the central metal atom is the same. According to "Electrophotography -the Society Journal- Vol. 29, No. 4 (1990)", it is reported that the properties of the photoconductor vary depending on the crystal system of the phthalocyanine contained in the photoconductor. In light of the obtained photoconductive properties, therefore, it is important to employ each phthalocyanine in the optimal crystal system.

The above-mentioned charge generation materials with phthalocyanine skeleton may be used in combination in the charge generation layer 31. Further, such charge generation materials with phthalocyanine skeleton may be used in combination with other charge generation materials. In this case, inorganic and organic conventional charge generation materials can be employed.

Specific examples of the inorganic charge generation material are crystalline selenium, amorphous selenium, selenium-tellurium, selenium-tellurium-halogen, selenium-arsenic compound, and a-silicon (amorphous silicon). In particular, when the above-mentioned a-silicon is employed as the charge generation material, it is preferable that the dangling bond be terminated with hydrogen atom or a halogen atom, or be doped with boron atom or phosphorus atom.

Specific examples of the organic charge generation material are azulenium salt pigment, squaric acid methyne pigment, azo pigment having a carbazole skeleton, azo pigment having a triphenylamine skeleton, azo pigment having a diphenylamine skeleton, azo pigment having a dibenzothiophene skeleton, azo pigment having a fluorenone skeleton, azo pigment having an oxadiazole skeleton, azo pigment having a bisstilbene skeleton, azo pigment having a distyryl oxadiazole skeleton, azo pigment having a distyryl carbazole skeleton, perylene pigment, anthraquinone pigment, polycyclic quinone pigment, quinone imine pigment, diphenylmethane pigment, triphenylmethane pigment, benzoquinone pigment, naphthoquinone pigment, cyanine pigment, azomethine pigment, indigoid pigment, and bisbenzimidazole pigment.

The charge generation layer 31 may further comprise a binder resin when necessary.

Examples of the binder resin for use in the charge generation layer 31 are polyamide, polyurethane, epoxy resin, polyketone, polycarbonate, silicone resin, acrylic resin, polyvinyl butyral, polyvinyl formal, polyvinyl ketone, polystyrene, poly-N-vinylcarbazole and polyacrylamide. Those binder resins may be used alone or in combination.

Further, in the charge generation layer 31, the previously mentioned high-molecular weight charge transport material and a low-molecular weight charge transport material may be contained when necessary.

The low-molecular weight charge transport material for use in the charge generation layer 31 includes a positive hole transport material and an electron transport material.

Examples of the electron transport material are conventional electron acceptor compounds such as chloroanil, bromoanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, and 1,3,7-trinitrodibenzotiophene-5,5-dioxide. Those electron transport materials may be used alone or in combination.

Examples of the positive hole transport material are electron donor compounds such as oxazole derivatives, oxadiazole derivatives, imidazole derivatives, triphenylamine derivatives, 9-(p-diethylaminostyrylanthracene), 1,1-bis-(4-dibenzylaminophenyl)propane, styrylanthracene, styrylpyrazoline, phenylhydrazones, α-phenylstilbene derivatives, thiazole derivatives, triazole derivatives, phenazine derivatives, acridine derivatives, benzofuran derivatives, benzimidazole derivatives, and thiophene derivatives. Those positive hole transport materials may be used alone or in combination.

The charge generation layer 31 can be formed by vacuum thin-film forming method or casting method using a dispersion system.

The vacuum thin-film forming method is classified into vacuum deposition and chemical vapor deposition (CVD).

When the charge generation layer 31 is formed by the casting method, the charge generation material is dispersed in a proper solvent such as tetrahydrofuran, cyclohexanone, dioxane, dichloroethane or butanone, optionally in combination with a binder agent, in a ball mill, an attritor or a sand mill. The dispersion thus obtained may appropriately be diluted to prepare a coating liquid for the charge generation layer 31. The coating of the coating liquid for the charge generation layer 31 is achieved by dip coating, spray coating or beads coating.

The proper thickness of the charge generation layer thus formed is about 0.01 to 5 μm, and preferably in the range of 0.05 to 2 μm.

The charge transport layer 33 will now be explained in detail.

As previously mentioned, the charge transport layer 33 comprises a high-molecular weight charge transport material with a polycarbonate structure comprising a triarylamino group at least on the main chain or side chain thereof, preferably the above-mentioned high-molecular weight compounds of formulas (I) to (VIII).

To provide the charge transport layer 33, the above-mentioned high-molecular weight charge transport material is dissolved or dispersed in an appropriate solvent to prepare a coating liquid, and the coating liquid thus prepared is coated and dried. When necessary, the charge transport layer 33 may further comprise a proper binder resin, a low-molecular weight charge transport material, a plasticizer and a leveling agent.

Examples of the binder resin for use in the charge transport layer 33 are polycarbonate (bisphenol A and bisphenol Z), polyester, methacrylic resin, acrylic resin, polyethylene, vinyl chloride, vinyl acetate, polystyrene, phenolic resin, epoxy resin, polyurethane, polyvinylidene chloride, alkyd resin, silicone resin, polyvinylcarbazole, polyvinyl butyral, polyvinyl formal, polyacrylate, polyacrylamide and phenoxy resin. Those binder resins can be used alone or in combination.

The same low-molecular weight charge transport materials as mentioned in the charge generation layer 31 are usable in the charge transport layer 33.

Any plasticizer used for general resins, such as dibutyl phthalate or dioctyl phthalate may be added to the charge transport layer coating liquid as it is. In this case, it is proper that the amount of plasticizer be in the range of about 0 to 30 parts by weight to 100 parts by weight of the binder resin for use in the charge transport layer 33.

As the leveling agent for use in the charge transport layer coating liquid, there can be employed silicone oils such as dimethyl silicone oil and methylphenyl silicone oil, and polymers and oligomers having a perfluoroalkyl group on the side chain thereof. The proper amount of leveling agent is in the range of 0 to one part by weight to 100 parts by weight of the binder resin for use in the charge transport layer 33.

It is preferable that the thickness of the charge transport layer 33 be in the range of about 5 to 100 μm, more preferably about 10 to 40 μm.

The photoconductive layer 23 with such a single-layered structure as shown in FIG. 1 will now be described.

When the single-layered photoconductive layer 23 is provided on the electroconductive support 21 by the casting method, the function-separating photoconductive layer 23 which comprises the previously mentioned charge generation material, high-molecular weight charge transport material, and low-molecular weight charge transport material is preferably employed. In this case, the plasticizer and leveling agent may be contained in the photoconductive layer 23. Further, the single-layered photoconductive layer 23 may further comprise a binder resin when necessary. In such a case, the same binder resin as mentioned in the charge transport layer 33 may be used alone, or in combination with the same binder resin as mentioned in the charge generation layer 31.

It is preferable that the single-layered photoconductive layer 23 be in the range of about 5 to 100 μm, more preferably 10 to 40 μm.

In the electrophotographic photoconductor according to the present invention, an undercoat layer 25 may be interposed between the electroconductive support 21 and the photoconductive layer 23, as shown in FIG. 3, in order to improve the adhesion of the photoconductive layer 23 to the support 21, prevent the occurrence of moire, improve the coating properties of the photoconductive layer 23, and reduce the residual potential.

The undercoat layer 25 comprises a resin as the main component. The photoconductive layer is provided on the undercoat layer by coating method using a solvent, so that it is desirable that the resin for use in the undercoat layer 25 have high resistance against generally used organic solvents.

Preferable examples of the resin for use in the undercoat layer 25 include water-soluble resins such as polyvinyl alcohol, casein and sodium polyacrylate; alcohol-soluble resins such as copolymer nylon an methoxymethylated nylon; and hardening resins with three-dimensional network such as polyurethane, melamine resin, alkyd-melamine resin and epoxy resin.

The undercoat layer 25 may further comprise finely-divided particles of metallic oxides such as titanium oxide, silica, alumina, zirconium oxide, tin oxide and indium oxide; metallic sulfides; and metallic nitrides.

The undercoat layer 25 can be provided on the electroconductive support 21 by the coating method as previously explained in the formation of the photoconductive layer 23, using an appropriate solvent.

The undercoat layer 25 for use in the present invention may be a metallic oxide layer prepared by the sol-gel processing using a coupling agent such as silane coupling agent, titanium coupling agent or chromium coupling agent.

Furthermore, to prepare the undercoat layer 25, $Al_2O_3$ may be deposited on the electroconductive support 21 by the anodizing process, or an organic material such as poly-para-xylylene (parylene), or inorganic materials such as SiO, $SnO_2$, $TiO_2$, ITO and $CeO_2$ may be vacuum-deposited on the electroconductive support 21.

It is preferable that the thickness of the undercoat layer 25 be in the range of 0 to 5 $\mu$m.

In the present invention, an antioxidant may be contained in any layer that comprises an organic material in order to improve the environmental resistance, to be more specific, to prevent the decrease of photosensitivity and the increase of residual potential.

In particular, when the antioxidant is added to the layer comprising the charge transport material, excellent results can be obtained.

Examples of the antioxidants for use in the present invention are as follows:

(1) Monophenol compounds:

2,6-di-t-butyl-p-cresol, butylated hydroxyanisole, 2,6-di-t-butyl-4-ethylphenol, and stearyl-β-(3,5-di-t-butyl-4-hydroxyphenyl)propionate.

(2) Bisphenol compounds:

2,2'-methylene-bis-(4-methyl-6-t-butylphenol), 2,2'-methylene-bis-(4-ethyl-6-t-butylphenol), 4,4'-thiobis-(3-methyl-6-t-butylphenol), and 4,4'-butylidenebis-(3-methyl-6-t-butylphenol).

(3) Polymeric phenol compounds:

1,1,3-tris-(2-methyl-4-hydroxy-5-t-butylphenyl)butane, 1,3,5-trimethyl-2,4,6-tris(3,5-di-t-butyl-4-hydroxybenzyl) benzene, tetrakis-[methylene-3-(3',5'-di-t-butyl-4'-hydroxyphenyl)propionate]methane, bis[3,3'-bis(4'-hydroxy-3'-t-butylphenyl)butylic acid]glycol ester, and tocopherol.

(4) Paraphenylenediamine compounds:

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.

(5) Hydroquinone compounds:

2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

(6) Organic sulfur-containing compounds:

Dilauryl-3,3'-thiodipropionate, distearyl-3,3'-thiodipropionate, and ditetradecyl-3,3'-thiodipropionate.

(7) Organic phosphorus-containing compounds:

Triphenylphosphine, tri(nonylphenyl)phosphine, tri (dinonylphenyl)phosphine, tricresylphosphine, and tri(2,4-di-butylphenoxy)phosphine.

The above-mentioned compounds (1) to (7) are conventionally known as the antioxidants for rubbers, plastics, and fats and oils, and easily available from the commercially available products.

It is preferable that the amount of antioxidant be in the range of 0.1 to 100 parts by weight, more preferably in the range of 2 to 30 parts by weight, to 100 parts by weight of the charge transport material.

Other features of this invention will become apparent in the course of the following description of exemplary embodiments, which are given for illustration of the invention and are not intended to be limiting thereof.

EXAMPLE 1

[Formation of undercoat layer]

The following components were mixed to prepare a coating liquid for an undercoat layer:

| | Parts by Weight |
|---|---|
| Alkyd resin "Beckosol 1307-60-EL" (Trademark), made by Dainippon Ink & Chemicals, Incorporated | 6 |
| Melamine resin "Super Beckamine G-821-60" (Trademark), made by Dainippon Ink & Chemicals, Incorporated | 4 |
| Titanium oxide | 40 |
| Methyl ethyl ketone | 200 |

The thus obtained coating liquid was coated on the outer surface of an aluminum cylinder with an outer diameter of 80 mm, and dried, whereby an undercoat layer with a thickness of 3.5 $\mu$m was provided on the surface of the aluminum cylinder.

[Formation of charge generation layer]

The following components were mixed to prepare a coating liquid for a charge generation layer:

| | Parts by Weight |
|---|---|
| Magnesium phthalocyanine | 0.75 |
| Polyvinyl butyral "XYHL" (Trademark), made by Union Carbide Japan K.K. | 0.25 |
| Tetrahydrofuran | 300 |

The thus obtained coating liquid was coated on the above prepared undercoat layer, whereby a charge generation layer with a thickness of 0.2 $\mu$m was provided on the undercoat layer.

[Formation of charge transport layer]

The following components were mixed to prepare a coating liquid for a charge transport layer:

| | Parts by Weight |
|---|---|
| High-molecular weight charge transport material of the following formula: | 10 |

-continued

| | Parts by Weight |
|---|---|
| 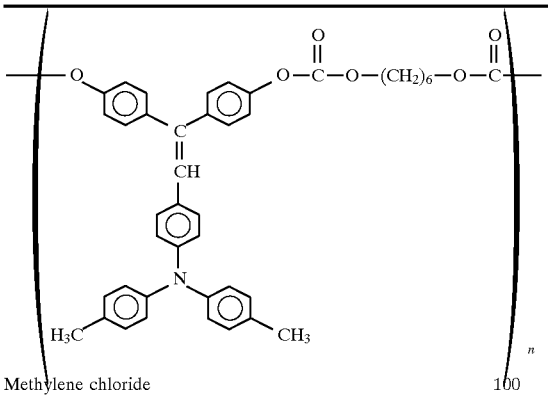 | |
| Methylene chloride | 100 |

The thus obtained coating liquid was coated on the above prepared charge generation layer and dried, whereby a charge transport layer with a thickness of 25 μm was provided on the charge generation layer.

Thus, an electrophotographic photoconductor No. 1 according to the present invention was fabricated.

EXAMPLE 2

The procedure for the fabrication of the photoconductor No. 1 of the present invention in Example 1 was repeated except that the high-molecular weight charge transport material for use in the charge transport layer coating liquid in Example 1 was replaced by a charge transport material of the following formula:

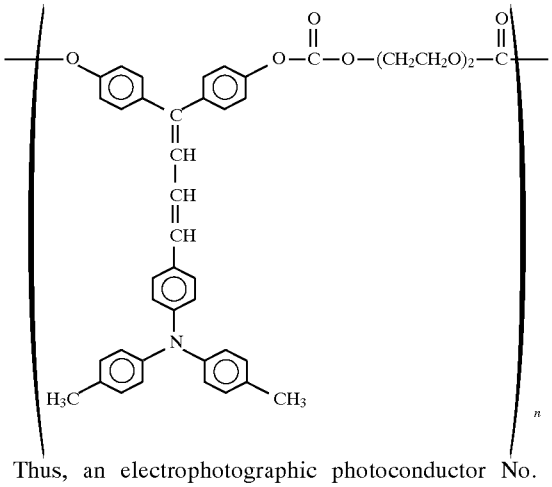

Thus, an electrophotographic photoconductor No. 2 according to the present invention was fabricated.

EXAMPLE 3

The procedure for the fabrication of the photoconductor No. 1 of the present invention in Example 1 was repeated except that the magnesium phthalocyanine for use in the charge generation layer coating liquid in Example 1 was replaced by aluminum chlorophthalocyanine, and that the high-molecular weight charge transport material for use in the charge transport layer coating liquid in Example 1 was replaced by a charge transport material of the following formula:

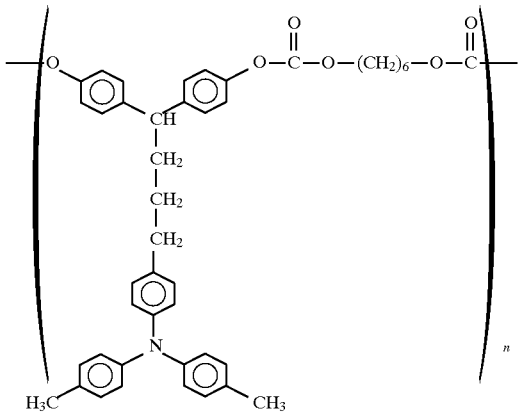

Thus, an electrophotographic photoconductor No. 3 according to the present invention was fabricated.

EXAMPLE 4

The procedure for the fabrication of the photoconductor No. 3 of the present invention in Example 3 was repeated except that the high-molecular weight charge transport material for use in the charge transport layer coating liquid in Example 3 was replaced by a charge transport material of the following formula:

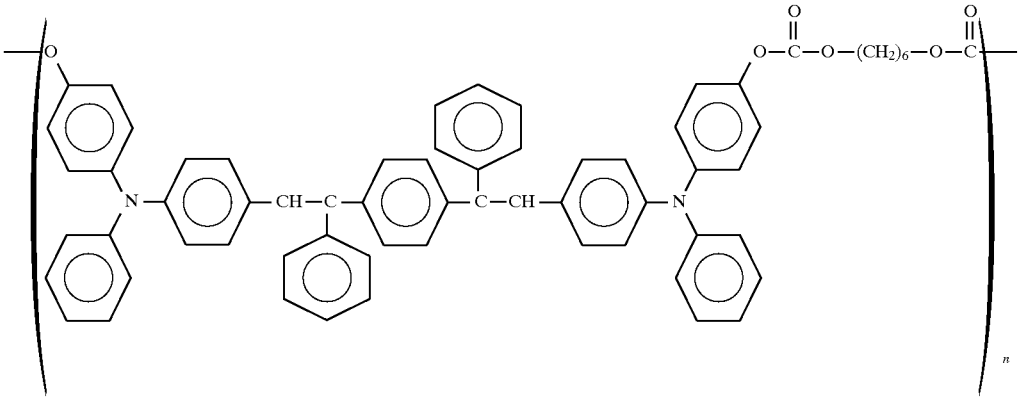

Thus, an electrophotograhic photoconductor No. 4 according to the present invention was fabricated.

EXAMPLE 5

The procedure for the fabrication of the photoconductor No. 3 of the present invention in Example 3 was repeated except that the high-molecular weight charge transport material for use in the charge transport layer coating liquid in Example 3 was replaced by a charge transport material of the following formula:

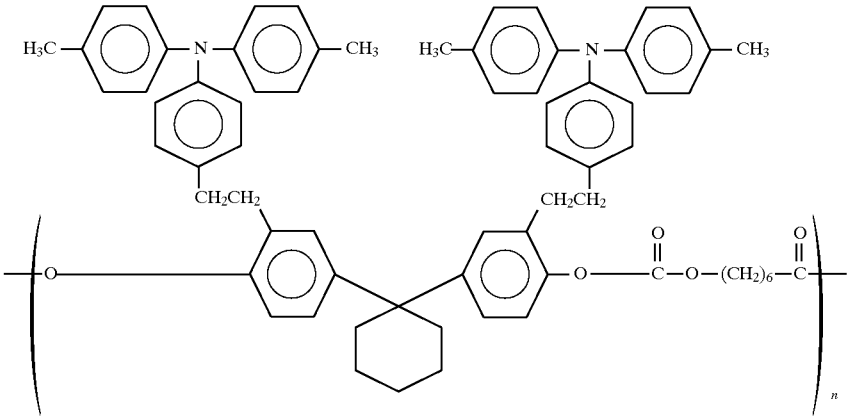

Thus, an electrophotograhic photoconductor No. 5 according to the present invention was fabricated.

EXAMPLE 6

The procedure for the fabrication of the photoconductor No. 3 of the present invention in Example 3 was repeated except that the high-molecular weight charge transport material for use in the charge transport layer coating liquid in Example 3 was replaced by a charge transport material of the following formula:

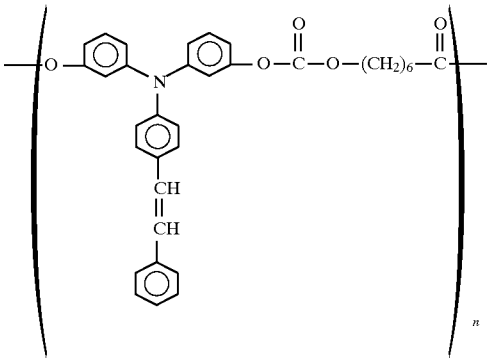

Thus, an electrophotographic photoconductor No. 6 according to the present invention was fabricated.

EXAMPLE 7

The procedure for the fabrication of the photoconductor No. 1 of the present invention in Example 1 was repeated except that the high-molecular weight charge transport material for use in the charge transport layer coating liquid in Example 1 was replaced by a charge transport material of the following formula:

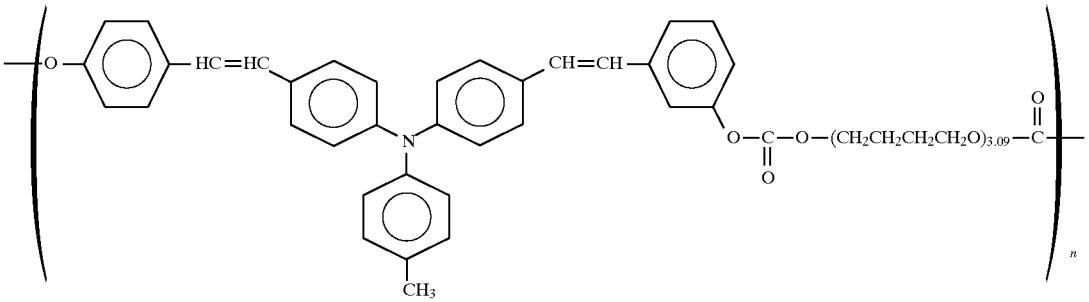

Thus, an electrophotographic photoconductor No. 7 according to the present invention was fabricated.

EXAMPLE 8

The procedure for the fabrication of the photoconductor No. 1 of the present invention in Example 1 was repeated except that the high-molecular weight charge transport material for use in the charge transport layer coating liquid in Example 1 was replaced by a charge transport material of the following formula:

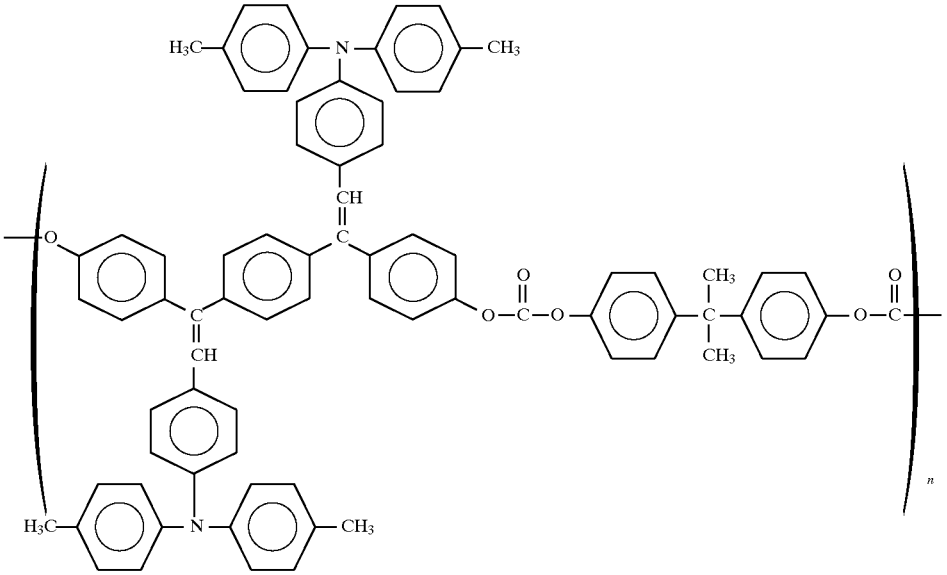

Thus, an electrophotographic photoconductor No. 8 according to the present invention was fabricated.

EXAMPLE 9

The procedure for the fabrication of the photoconductor No. 1 of the present invention in Example 1 was repeated except that the magnesium phthalocyanine serving as the charge generation material for use in the charge generation layer coating liquid in Example 1 was replaced by oxotitanium phthalocyanine.

Thus, an electrophotographic photoconductor No. 9 according to the present invention was fabricated.

EXAMPLE 10

The procedure for the fabrication of the photoconductor No. 2 of the present invention in Example 2 was repeated except that the magnesium phthalocyanine serving as the charge generation material for use in the charge generation layer coating liquid in Example 2 was replaced by oxotitanium phthalocyanine.

Thus, an electrophotographic photoconductor No. 10 according to the present invention was fabricated.

EXAMPLE 11

The procedure for the fabrication of the photoconductor No. 3 of the present invention in Example 3 was repeated except that the aluminum chlorophthalocyanine serving as the charge generation material for use in the charge generation layer coating liquid in Example 3 was replaced by oxotitanium phthalocyanine.

Thus, an electrophotographic photoconductor No. 11 according to the present invention was fabricated.

EXAMPLE 12

The procedure for the fabrication of the photoconductor No. 4 of the present invention in Example 4 was repeated except that the aluminum chlorophthalocyanine serving as the charge generation material for use in the charge generation layer coating liquid in Example 4 was replaced by oxotitanium phthalocyanine.

Thus, an electrophotographic photoconductor No. 12 according to the present invention was fabricated.

EXAMPLE 13

The procedure for the fabrication of the photoconductor No. 5 of the present invention in Example 5 was repeated except that the aluminum chlorophthalocyanine serving as the charge generation material for use in the charge generation layer coating liquid in Example 5 was replaced by oxotitanium phthalocyanine.

Thus, an electrophotographic photoconductor No. 13 according to the present invention was fabricated.

EXAMPLE 14

The procedure for the fabrication of the photoconductor No. 6 of the present invention in Example 6 was repeated except that the aluminum chlorophthalocyanine serving as the charge generation material for use in the charge generation layer coating liquid in Example 6 was replaced by oxotitanium phthalocyanine.

Thus, an electrophotographic photoconductor No. 14 according to the present invention was fabricated.

EXAMPLE 15

The procedure for the fabrication of the photoconductor No. 7 of the present invention in Example 7 was repeated except that the magnesium phthalocyanine serving as the charge generation material for use in the charge generation layer coating liquid in Example 7 was replaced by oxotitanium phthalocyanine.

Thus, an electrophotographic photoconductor No. 15 according to the present invention was fabricated.

EXAMPLE 16

The procedure for the fabrication of the photoconductor No. 8 of the present invention in Example 8 was repeated except that the magnesium phthalocyanine serving as the charge generation material for use in the charge generation layer coating liquid in Example 8 was replaced by oxotitanium phthalocyanine.

Thus, an electrophotographic photoconductor No. 16 according to the present invention was fabricated.

EXAMPLE 17

The procedure for the fabrication of the photoconductor No. 1 of the present invention in Example 1 was repeated except that the magnesium phthalocyanine serving as the charge generation material for use in the charge generation layer coating liquid in Example 1 was replaced by metal-free phthalocyanine.

Thus, an electrophotographic photoconductor No. 17 according to the present invention was fabricated.

EXAMPLE 18

The procedure for the fabrication of the photoconductor No. 2 of the present invention in Example 2 was repeated except that the magnesium phthalocyanine serving as the charge generation material for use in the charge generation layer coating liquid in Example 2 was replaced by metal-free phthalocyanine.

Thus, an electrophotographic photoconductor No. 18 according to the present invention was fabricated.

EXAMPLE 19

The procedure for the fabrication of the photoconductor No. 3 of the present invention in Example 3 was repeated except that the aluminum chlorophthalocyanine serving as the charge generation material for use in the charge generation layer coating liquid in Example 3 was replaced by metal-free phthalocyanine.

Thus, an electrophotographic photoconductor No. 19 according to the present invention was fabricated.

EXAMPLE 20

The procedure for the fabrication of the photoconductor No. 4 of the present invention in Example 4 was repeated except that the aluminum chlorophthalocyanine serving as the charge generation material for use in the charge generation layer coating liquid in Example 4 was replaced by metal-free phthalocyanine.

Thus, an electrophotographic photoconductor No. 20 according to the present invention was fabricated.

EXAMPLE 21

The procedure for the fabrication of the photoconductor No. 5 of the present invention in Example 5 was repeated except that the aluminum chlorophthalocyanine serving as the charge generation material for use in the charge generation layer coating liquid in Example 5 was replaced by metal-free phthalocyanine.

Thus, an electrophotographic photoconductor No. 21 according to the present invention was fabricated.

EXAMPLE 22

The procedure for the fabrication of the photoconductor No. 6 of the present invention in Example 6 was repeated except that the aluminum chlorophthalocyanine serving as the charge generation material for use in the charge generation layer coating liquid in Example 6 was replaced by metal-free phthalocyanine.

Thus, an electrophotographic photoconductor No. 22 according to the present invention was fabricated.

EXAMPLE 23

The procedure for the fabrication of the photoconductor No. 7 of the present invention in Example 7 was repeated except that the magnesium phthalocyanine serving as the charge generation material for use in the charge generation layer coating liquid in Example 7 was replaced by metal-free phthalocyanine.

Thus, an electrophotographic photoconductor No. 23 according to the present invention was fabricated.

EXAMPLE 24

The procedure for the fabrication of the photoconductor No. 8 of the present invention in Example 8 was repeated except that the magnesium phthalocyanine serving as the charge generation material for use in the charge generation layer coating liquid in Example 8 was replaced by metal-free phthalocyanine.

Thus, an electrophotographic photoconductor No. 24 according to the present invention was fabricated.

COMPARATIVE EXAMPLE 1

The procedure for the fabrication of the photoconductor No. 1 of the present invention in Example 1 was repeated except that the magnesium phthalocyanine serving as the charge generation material for use in the charge generation layer coating liquid in Example 1 was replaced by a charge generation material of the following formula:

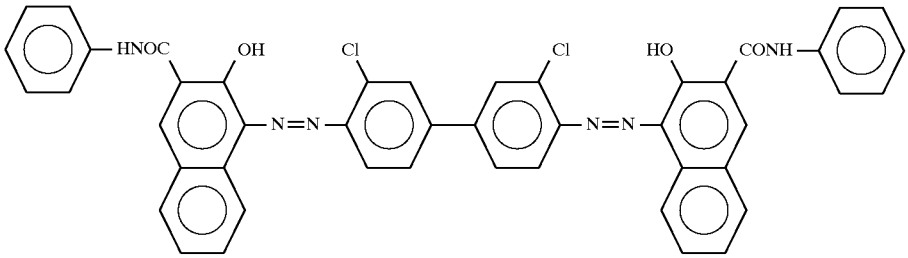

Thus, a comparative electrophotographic photoconductor No. 1 was fabricated.

COMPARATIVE EXAMPLE 2

The procedure for the fabrication of the photoconductor No. 2 of the present invention in Example 2 was repeated except that the magnesium phthalocyanine serving as the charge generation material for use in the charge generation layer coating liquid in Example 2 was replaced by the same charge generation material as employed in Comparative Example 1.

Thus, a comparative electrophotographic photoconductor No. 2 was fabricated.

COMPARATIVE EXAMPLE 3

The procedure for the fabrication of the photoconductor No. 3 of the present invention in Example 3 was repeated except that the aluminum chlorophthalocyanine serving as the charge generation material for use in the charge generation layer coating liquid in Example 3 was replaced by the same charge generation material as employed in Comparative Example 1.

Thus, a comparative electrophotographic photoconductor No. 3 was fabricated.

COMPARATIVE EXAMPLE 4

The procedure for the fabrication of the photoconductor No. 4 of the present invention in Example 4 was repeated except that the aluminum chlorophthalocyanine serving as the charge generation material for use in the charge generation layer coating liquid in Example 4 was replaced by the same charge generation material as employed in Comparative Example 1.

Thus, a comparative electrophotographic photoconductor No. 4 was fabricated.

COMPARATIVE EXAMPLE 5

The procedure for the fabrication of the photoconductor No. 5 of the present invention in Example 5 was repeated except that the aluminum chlorophthalocyanine serving as the charge generation material for use in the charge generation layer coating liquid in Example 5 was replaced by the same charge generation material as employed in Comparative Example 1.

Thus, a comparative electrophotographic photoconductor No. 5 was fabricated.

COMPARATIVE EXAMPLE 6

The procedure for the fabrication of the photoconductor No. 6 of the present invention in Example 6 was repeated except that the aluminum chlorophthalocyanine serving as the charge generation material for use in the charge generation layer coating liquid in Example 6 was replaced by the same charge generation material as employed in Comparative Example 1.

Thus, a comparative electrophotographic photoconductor No. 6 was fabricated.

COMPARATIVE EXAMPLE 7

The procedure for the fabrication of the photoconductor No. 7 of the present invention in Example 7 was repeated except that the magnesium phthalocyanine serving as the charge generation material for use in the charge generation layer coating liquid in Example 7 was replaced by the same charge generation material as employed in Comparative Example 1.

Thus, a comparative electrophotographic photoconductor No. 7 was fabricated.

COMPARATIVE EXAMPLE 8

The procedure for the fabrication of the photoconductor No. 8 of the present invention in Example 8 was repeated except that the magnesium phthalocyanine serving as the charge generation material for use in the charge generation layer coating liquid in Example 8 was replaced by the same charge generation material as employed in Comparative Example 1.

Thus, a comparative electrophotographic photoconductor No. 8 was fabricated.

COMPARATIVE EXAMPLE 9

The procedure for the fabrication of the photoconductor No. 1 of the present invention in Example 1 was repeated except that the formulation for the charge transport layer coating liquid used in Example 1 was changed to the following formulation:

| | Parts by Weight |
|---|---|
| Bisphenol A type polycarbonate "Panlite K-1300" (Trademark), made by Teijin Chemicals Ltd. | 10 |
| Low-molecular weight charge transport material of the following formula: | 10 |

-continued

| | Parts by Weight |
|---|---|
| 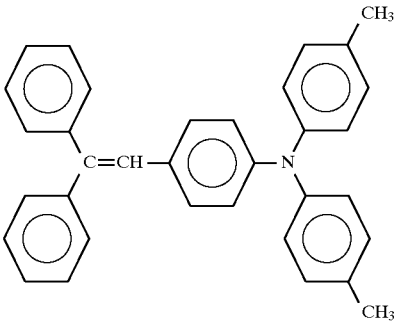 | |
| Methylene chloride | 100 |

Thus, a comparative electrophotographic photoconductor No. 9 was fabricated.

Each of the above fabricated electrophotographic photoconductors No. 1 to No. 24 according to the present invention and comparative electrophotographic photoconductors No. 1 to No. 9 was charged negatively in the dark under application of −6 kV of corona charge for 20 seconds, using a commercially available electrostatic copying sheet testing apparatus "Paper Analyzer Model SP-428" (Trademark), made by Kawaguchi Electro Works Co., Ltd. Then, each photoconductor was allowed to stand in the dark without applying any charges thereto until the surface potential reached −800 V.

Each photoconductor was then illuminated by a tungsten lamp in such a manner that the illuminance on the illuminated surface of the photoconductor was 6 lux, and the exposure $E_{200}$ (lux·sec) required to reduce the surface potential to −200 V was measured.

Furthermore, the surface potential $V_{30}$ (V) of the photoconductor was measured after it was exposed to the tungsten lamp for 30 seconds.

The results are shown in TABLE 1.

In addition, each of the photoconductors No. 1 to No. 8 according to the present invention and the comparative photoconductor No. 9 was incorporated in a commercially available electrophotographic copying machine (Trademark "IMAGIO MF530" made by Ricoh Company, Ltd.) and subjected to a durability test by making 50,000 copies. After making of 50,000 copies, the occurrence of abnormal image was examined in terms of toner deposition on the background and image blurring.

The results are shown in TABLE 2.

TABLE 1

| | $E_{200}$ (lux · sec) | $V_{30}$ (V) |
|---|---|---|
| Ex. 1 | 0.82 | −27 |
| Ex. 2 | 0.96 | −33 |
| Ex. 3 | 1.01 | −28 |
| Ex. 4 | 1.32 | −24 |
| Ex. 5 | 0.84 | −29 |
| Ex. 6 | 0.79 | −36 |
| Ex. 7 | 0.66 | −22 |
| Ex. 8 | 1.11 | −27 |
| Ex. 9 | 0.53 | −30 |
| Ex. 10 | 0.62 | −34 |
| Ex. 11 | 0.7 | −32 |
| Ex. 12 | 0.92 | −25 |

TABLE 1-continued

| | $E_{200}$ (lux · sec) | $V_{30}$ (V) |
|---|---|---|
| Ex. 13 | 0.59 | −29 |
| Ex. 14 | 0.54 | −31 |
| Ex. 15 | 0.41 | −36 |
| Ex. 16 | 0.73 | −27 |
| Ex. 17 | 0.61 | −26 |
| Ex. 18 | 0.71 | −28 |
| Ex. 19 | 0.74 | −24 |
| Ex. 20 | 1.02 | −26 |
| Ex. 21 | 0.64 | −23 |
| Ex. 22 | 0.61 | −30 |
| Ex. 23 | 0.47 | −34 |
| Ex. 24 | 0.79 | −25 |
| Comp. Ex. 1 | 2.81 | −70 |
| Comp. Ex. 2 | 3.3 | −75 |
| Comp. Ex. 3 | 3.73 | −64 |
| Comp. Ex. 4 | 4.89 | −73 |
| Comp. Ex. 5 | 3.13 | −62 |
| Comp. Ex. 6 | 2.81 | −81 |
| Comp. Ex. 7 | 2.27 | −92 |
| Comp. Ex. 8 | 3.81 | −67 |
| Comp. Ex. 9 | 0.94 | −32 |

TABLE 2

| | Occurrence of Abnormal Image (*) |
|---|---|
| Ex. 1 | ○ |
| Ex. 2 | ○ |
| Ex. 3 | ○ |
| Ex. 4 | Δ |
| Ex. 5 | ○ |
| Ex. 6 | ○ |
| Ex. 7 | ○ |
| Ex. 8 | ○ |
| Comparative Ex. 9 | x |

(*)○: No abnormal image was observed.
Δ: Abnormal image was partially observed.
x: Abnormal image was entirely observed.

As previously mentioned, the photoconductive layer of the photoconductor comprises a high-molecular weight charge transport material with a polycarbonate structure comprising a triarylamino group at least on the main chain or side chain thereof, which charge transport material shows excellent wear resistance during the repeated operations of the photoconductor. Since the photoconductive layer comprises the above-mentioned high-molecular weight charge transport material and a charge generation material with a phthalocyanine skeleton, the photosensitivity is improved and image formation can be stably carried out for an extended period of time.

Japanese Patent Application No. 8-151813 filed on May 24, 1996 is hereby incorporated by reference.

What is claimed is:

1. An electrophotographic photoconductor comprising an electroconductive support and a photoconductive layer formed thereon, comprising:

a charge transport material with a polycarbonate structure comprising a triarylamino group at least on the main chain or side chain thereof, and a charge generation material with a phthalocyanine skeleton.

2. The electrophotographic photoconductor as claimed in claim 1, wherein said charge transport material has formula (I):

(I)

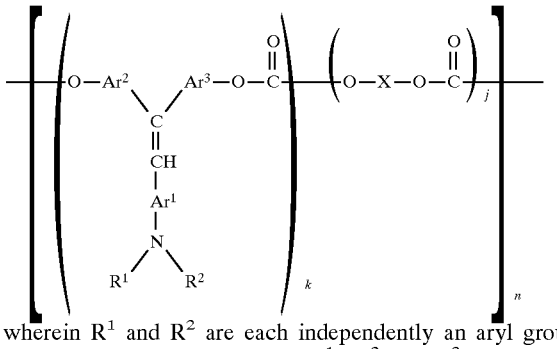

wherein $R^1$ and $R^2$ are each independently an aryl group which may have a substituent; $Ar^1$, $Ar^2$ and $Ar^3$, which may be the same or different, are each independently an arylene group; $0.1 \leqq k \leqq 1$; $0 \leqq j \leqq 0.9$; n is an integer of 5 to 5,000; X is a bivalent aliphatic group, bivalent cyclic aliphatic group or a bivalent group represented by formula (I-a):

(I-a)

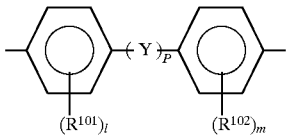

in which $R^{101}$ and $R^{102}$ are each independently an alkyl group which may have a substituent, an aryl group which may have a substituent, or a halogen atom; l and m are each independently an integer of 0 to 4; p is an integer of 0 or 1, and when p=1, Y is a straight-chain, branched or cyclic alkylene group having 1 to 12 carbon atoms, —O—, —S—, —SO—, —$SO_2$—, —CO—, —CO—O—Z—O—CO— in which Z is a bivalent aliphatic group, or (I-b)

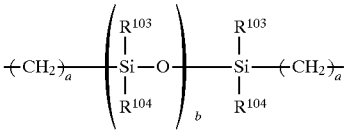

in which a is an integer of 1 to 20; b is an integer of 1 to 2,000; and $R^{103}$ and $R^{104}$ are each independently an alkyl group which may have a substituent or an aryl group which may have a substituent, and $R^{101}$, $R^{102}$, $R^{103}$ and $R^{104}$ may be the same or different.

3. The electrophotographic photoconductor as claimed in claim 1, wherein said charge transport material has formula (II):

(II)

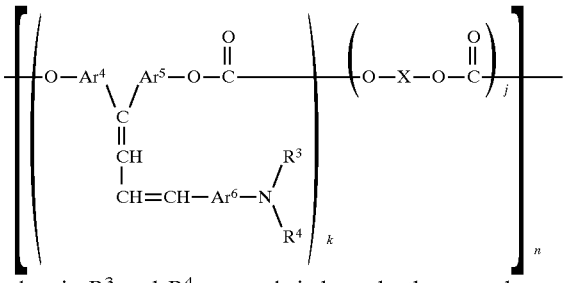

wherein $R^3$ and $R^4$ are each independently an aryl group which may have a substituent; $Ar^4$, $Ar^5$ and $Ar^6$ which may be the same or different, are each independently an arylene group; $0.1 \leqq k \leqq 1$; $0 \leqq j \leqq 0.9$; n is an integer of 5 to 5,000; and X is a bivalent aliphatic group, bivalent cyclic aliphatic group or a bivalent group represented by formula (I-a):

(I-a)

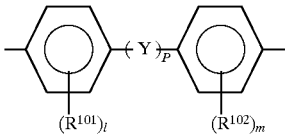

in which $R^{101}$ and $R^{102}$ are each independently an alkyl group which may have a substituent, an aryl group which may have a substituent, or a halogen atom; l and m are each independently an integer of 0 to 4; p is an integer of 0 or 1, and when p=1, Y is a straight-chain, branched or cyclic alkylene group having 1 to 12 carbon atoms, —O—, —S—, —SO—, —$SO_2$—, —CO—, —CO—O—Z—O—CO— in which Z is a bivalent aliphatic group, or (I-b)

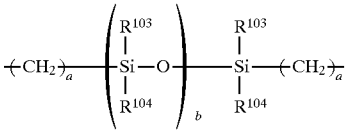

in which a is an integer of 1 to 20; b is an integer of 1 to 2,000; and $R^{103}$ and $R^{104}$ are each independently an alkyl group which may have a substituent or an aryl group which may have a substituent, and $R^{101}$, $R^{102}$, $R^{103}$ and $R^{104}$ may be the same or different.

4. The electrophotographic photoconductor as claimed in claim 1, wherein said charge transport material has formula (III):

(III)

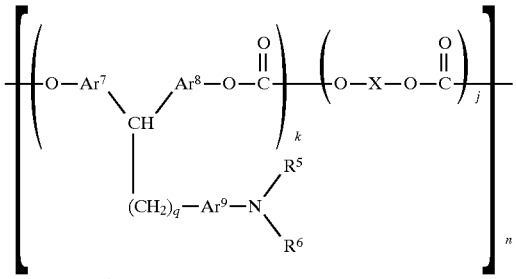

wherein $R^5$ and $R^6$ are each independently an aryl group which may have a substituent; $Ar^7$, $Ar^8$ and $Ar^9$, which may be the same or different, are each independently an arylene group; q is an integer of 1 to 5; $0.1 \leqq k \leqq 1$; $0 \leqq j \leqq 0.9$; n is an integer of 5 to 5,000; and X is a bivalent aliphatic group, bivalent cyclic aliphatic group or a bivalent group represented by formula (I-a):

(I-a)

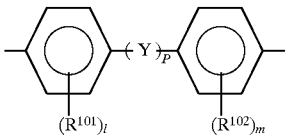

in which $R^{101}$ and $R^{102}$ are each independently an alkyl group which may have a substituent, an aryl group which may have a substituent, or a halogen atom; l and m are each independently an integer of 0 to 4; p is an integer of 0 or 1, and when p=1, Y is a straight-chain, branched or cyclic alkylene group having 1 to 12 carbon atoms, —O—, —S—, —SO—, —$SO_2$—, —CO—, —CO—O—Z—O—CO— in which Z is a bivalent aliphatic group, or

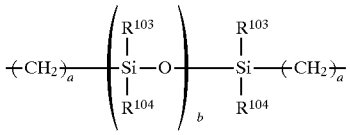

(I-b)

in which a is an integer of 1 to 20; b is an integer of 1 to 2,000; and $R^{103}$ and $R^{104}$ are each independently an alkyl group which may have a substituent or an aryl group which may have a substituent, and $R^{101}$, $R^{102}$, $R^{103}$ and $R^{104}$ may be the same or different.

5. The electrophotographic photoconductor as claimed in claim 1, wherein said charge transport material has formula (IV):

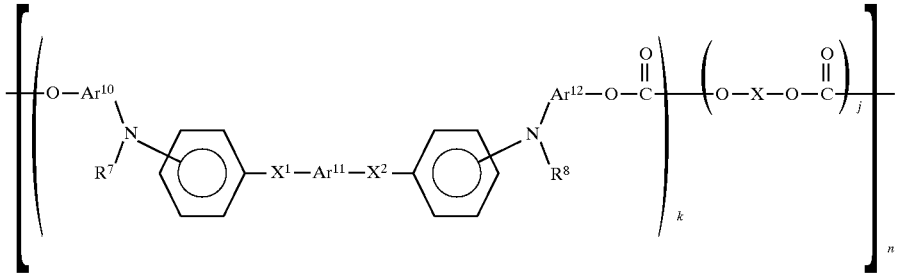

(V)

wherein $R^7$ and $R^8$ are each independently an aryl group which may have a substituent; $Ar^{10}$, $Ar^{11}$ and $Ar^{12}$, which may be the same or different, are each independently an arylene group; $X^1$ and $X^2$ are each independently ethylene group which may have a substituent or vinylene group which may have a substituent; $0.1 \leqq k \leqq 1$; $0 \leqq j \leqq 0.9$; n is an integer of 5 to 5,000; and X is a bivalent aliphatic group, bivalent cyclic aliphatic group or a bivalent group represented by formula (I-a):

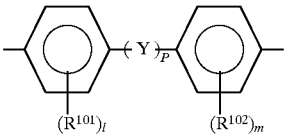

(I-a)

in which $R^{101}$ and $R^{102}$ are each independently an alkyl group which may have a substituent, an aryl group which may have a substituent, or a halogen atom; l and m are each independently an integer of 0 to 4; p is an integer of 0 or 1, and when p=1, Y is a straight-chain, branched or cyclic alkylene group having 1 to 12 carbon atoms, —O—, —S—, —SO—, —$SO_2$—, —CO—, —CO—O—Z—O—CO— in which Z is a bivalent aliphatic group, or

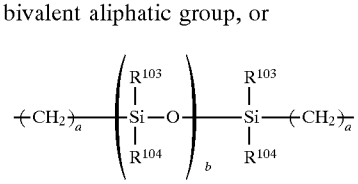

(I-b)

in which a is an integer of 1 to 20; b is an integer of 1 to 2,000; and $R^{103}$ and $R^{104}$ are each independently an alkyl group which may have a substituent or an aryl group which may have a substituent, and $R^{101}$, $R^{102}$, $R^{103}$ and $R^{104}$ may be the same or different.

6. The electrophotographic photoconductor as claimed in claim 1, wherein said charge transport material has formula (V):

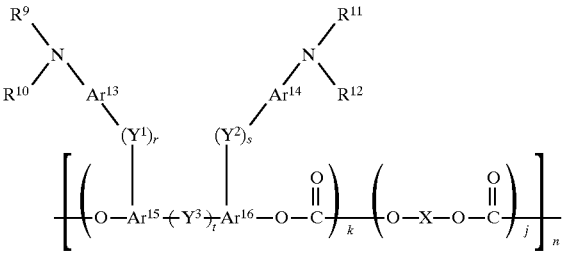

wherein $R^9$, $R^{10}$, $R^{11}$ and $R^{12}$ are each independently an aryl group which may have a substituent; $Ar^{13}$, $Ar^{14}$, $Ar^{15}$ and $Ar^{16}$, which may be the same or different, are each independently an arylene group; r, s and t are each independently an integer of 0 or 1, and when r, s and t are an integer of 1, $Y^1$, $Y^2$ and $Y^2$, which may be the same or different, are each independently an alkylene group which may have a substituent, a cycloalkylene group which may have a substituent, an alkylene ether group which may have a substituent, oxygen atom, sulfur atom, or vinylene group; $0.1 \leqq k \leqq 1$; $0 \leqq j \leqq 0.9$; n is an integer of 5 to 5,000; and X is a bivalent aliphatic group, bivalent cyclic aliphatic group or a bivalent group represented by formula (I-a):

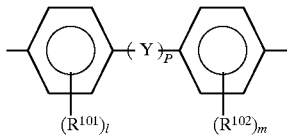

(I-a)

in which $R^{101}$ and $R^{102}$ are each independently an alkyl group which may have a substituent, an aryl group which may have a substituent, or a halogen atom; l and m are each independently an integer of 0 to 4; p is an integer of 0 or 1, and when p=1, Y is a straight-chain, branched or cyclic alkylene group having 1 to 12 carbon atoms, —O—, —S—, —SO—, —$SO_2$—, —CO—, —CO—O—Z—O—CO— in which Z is a bivalent aliphatic group, or

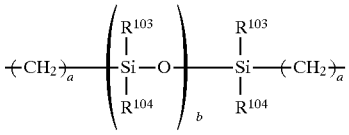

(I-b)

in which a is an integer of 1 to 20; b is an integer of 1 to 2,000; and $R^{103}$ and $R^{104}$ are each independently an alkyl group which may have a substituent or an aryl group which may have a substituent, and $R^{101}$, $R^{102}$, $R^{103}$ and $R^{104}$ may be the same or different.

7. The electrophotographic photoconductor as claimed in claim 1, wherein said charge transport material has formula (VI):

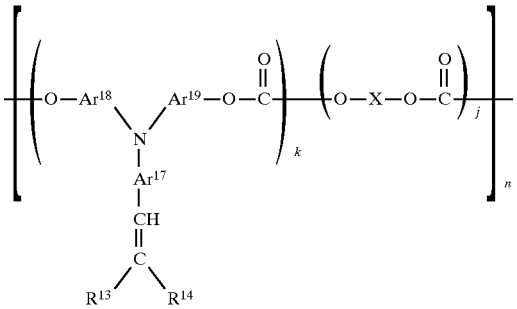

(VI)

wherein $R^{13}$ and $R^{14}$ are each independently a hydrogen atom, or an aryl group which may have a substituent, and $R^{13}$ and $R^{14}$ may form a ring in combination; $Ar^{17}$, $Ar^{18}$ and $Ar^{19}$, which may be the same or different, are each independently an arylene group; $0.1 \leqq k \leqq 1$; $0 \leqq j \leqq 0.9$; n is an integer of 5 to 5,000; and X is a bivalent aliphatic group, bivalent cyclic aliphatic group or a bivalent group represented by formula (I-a):

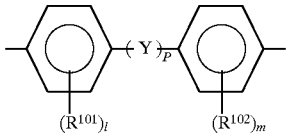

(I-a)

in which $R^{101}$ and $R^{102}$ are each independently an alkyl group which may have a substituent, an aryl group which may have a substituent, or a halogen atom; l and m are each independently an integer of 0 to 4; p is an integer of 0 or 1, and when p=1, Y is a straight-chain, branched or cyclic alkylene group having 1 to 12 carbon atoms, —O—, —S—, —SO—, —$SO_2$—, —CO—, —CO—O—Z—O—CO— in which Z is a bivalent aliphatic group, or

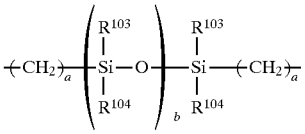

(I-b)

in which a is an integer of 1 to 20; b is an integer of 1 to 2,000; and $R^{103}$ and $R^{104}$ are each independently an alkyl group which may have a substituent or an aryl group which may have a substituent, and $R^{101}$, $R^{102}$, $R^{103}$ and $R^{104}$ may be the same or different.

8. The electrophotographic photoconductor as claimed in claim 1, wherein said charge transport material has formula (VII):

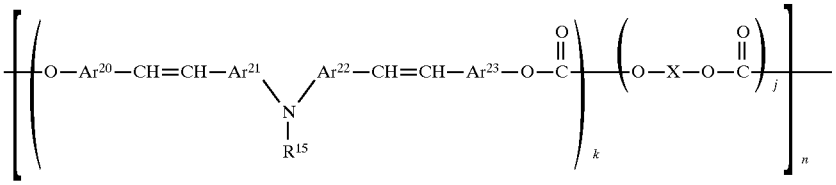

(VII)

wherein $R^{15}$ is an aryl group which may have a substituent; $Ar^{20}$, $Ar^{21}$, $Ar^{22}$ and $Ar^{23}$, which may be the same or different, are each independently an arylene group; $0.1 \leqq k \leqq 1$; $0 \leqq j \leqq 0.9$; n is an integer of 5 to 5,000; and X is a bivalent aliphatic group, bivalent cyclic aliphatic group or a bivalent group represented by formula (I-a):

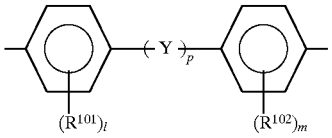

(I-a)

in which $R^{101}$ and $R^{102}$ are each independently an alkyl group which may have a substituent, an aryl group which may have a substituent, or a halogen atom; l and m are each independently an integer of 0 to 4; p is an integer of 0 or 1, and when p=1, Y is a straight-chain, branched or cyclic alkylene group having 1 to 12 carbon atoms, —O—, —S—, —SO—, —$SO_2$—, —CO—, —CO—O—Z—O—CO— in which Z is a bivalent aliphatic group, or

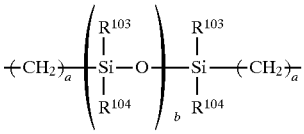

(I-b)

in which a is an integer of 1 to 20; b is an integer of 1 to 2,000; and $R^{103}$ and $R^{104}$ are each independently an alkyl group which may have a substituent or an aryl group which may have a substituent, and $R^{101}$, $R^{102}$, $R^{103}$ and $R^{104}$ may be the same or different.

9. The electrophotographic photoconductor as claimed in claim 1, wherein said charge transport material has formula (VIII):

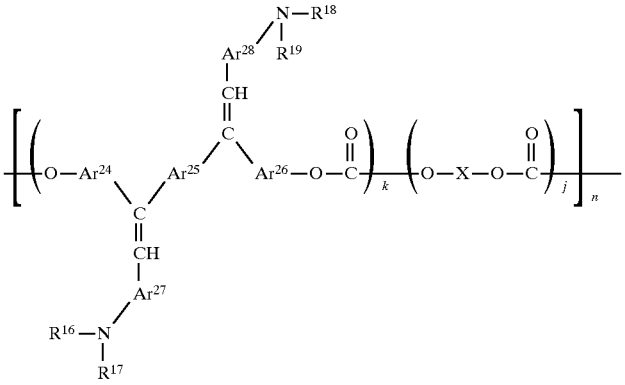

(VIII)

wherein $R^{16}$, $R^{17}$, $R^{18}$ and $R^{19}$ are each independently an aryl group which may have a substituent; $Ar^{24}$, $Ar^{25}$, $Ar^{26}$, $Ar^{27}$ and $Ar^{28}$, which may be the same or different, are each independently an arylene group; $0.1 \leqq k \leqq 1$; $0 \leqq j \leqq 0.9$; n is an integer of 5 to 5,000; and X is a bivalent aliphatic group, bivalent cyclic aliphatic group or a bivalent group represented by formula (I-a):

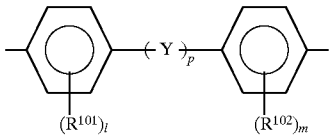

(I-a)

in which $R^{101}$ and $R^{102}$ are each independently an alkyl group which may have a substituent, an aryl group which may have a substituent, or a halogen atom; l and m are each independently an integer of 0 to 4; p is an integer of 0 or 1, and when p=1, Y is a straight-chain, branched or cyclic alkylene group having 1 to 12 carbon atoms, —O—, —S—, —SO—, —$SO_2$—, —CO—, —CO—O—Z—O—CO— in which Z is a bivalent aliphatic group, or

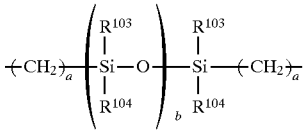

(I-b)

in which a is an integer of 1 to 20; b is an integer of 1 to 2,000; and $R^{103}$ and $R^{104}$ are each independently an alkyl group which may have a substituent or an aryl group which may have a substituent, and $R^{101}$, $R^{102}$, $R^{103}$ and $R^{104}$ may be the same or different.

10. The electrophotographic photoconductor as claimed in claim 1, wherein said charge generation material is an oxotitanium phthalocyanine compound.

11. The electrophotographic photoconductor as claimed in claim 1, wherein said charge generation material is a metal-free phthalocyanine compound.

* * * * *